US006820287B2

(12) United States Patent
Harbutt et al.

(10) Patent No.: US 6,820,287 B2
(45) Date of Patent: Nov. 23, 2004

(54) DOWN-STROKE DISPENSER

(75) Inventors: Richard P. Harbutt, Old Windsor (GB); David C. Snow, Gloucestershire (GB); Peter T. M. Nott, Wiltshire (GB); Simon M. Conway, Burlington, WI (US); Kevin Harrity, Oak Creek, WI (US); Steven A. Zach, Racine, WI (US); Nancy J. Sedlar, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/142,708

(22) Filed: May 10, 2002

(65) Prior Publication Data

US 2002/0194671 A1 Dec. 26, 2002

Related U.S. Application Data

(60) Provisional application No. 60/290,047, filed on May 11, 2001.

(51) Int. Cl.[7] ..... E03D 9/03

(52) U.S. Cl. ..... 4/227.3; 4/227.2; 4/227.4; 222/57

(58) Field of Search ..... 4/227.3, 227.2, 4/227.4, 227.5, 227.1; 222/56, 57

(56) References Cited

U.S. PATENT DOCUMENTS

| | | | |
|---|---|---|---|
| 1,602,554 A | 10/1926 | Schrank | |
| 2,587,388 A | 2/1952 | Ryder, Jr. | |
| 2,725,170 A | 11/1955 | Dav et al. | |
| 2,913,734 A | 11/1959 | O'Hare | |
| 3,278,094 A | 10/1966 | Perrv | |
| 3,416,577 A | 12/1968 | Franz | |
| 3,460,590 A | 8/1969 | Robbins | |
| 3,545,014 A | 12/1970 | Davis | |
| 3,698,021 A | 10/1972 | Mack et al. | |
| 3,774,808 A | 11/1973 | La Vange | |
| 3,778,850 A | 12/1973 | Bryan | |
| 3,841,524 A | 10/1974 | Easter | |
| 3,848,645 A | 11/1974 | Franz | |
| 3,850,209 A | 11/1974 | Zweigardt | |
| 3,871,425 A | 3/1975 | Fee et al. | |
| 3,874,007 A | 4/1975 | Dolan | |
| 3,883,024 A | 5/1975 | Thomas | |
| 3,913,151 A | 10/1975 | Keimig | |
| 4,066,187 A | 1/1978 | Nieman et al. | |
| 4,101,043 A | 7/1978 | Johnson, Jr. et al. | |
| 4,171,546 A | 10/1979 | Dirksing | 4/228 |
| 4,189,793 A | 2/1980 | Williamson et al. | |
| 4,285,074 A | 8/1981 | Leinberry | |
| 4,346,483 A | 8/1982 | Rosen et al. | |
| 4,356,848 A | 11/1982 | Spies | |
| 4,415,314 A | 11/1983 | Chappell | |
| 4,429,809 A | 2/1984 | Bousgarbies | |
| 4,436,269 A | 3/1984 | Dirksing et al. | |

(List continued on next page.)

FOREIGN PATENT DOCUMENTS

| | | | |
|---|---|---|---|
| EP | 1026331 | 8/2000 | |
| FR | 2407304 | 5/1979 | |
| FR | 2577895 | 8/1986 | B65D/47/00 |

(List continued on next page.)

*Primary Examiner*—Gregory L. Huson
*Assistant Examiner*—Kathleen J. Prunner

(57) ABSTRACT

A dispenser is provided for dispensing cleaning chemicals such as toilet bowl cleaners. It has a dosing chamber containing therein a floating shuttle that seals a lower opening in the dosing chamber and floats up there from as an aliquot of chemical is prepared for release during the next cycle. There is also a float controlled external valve head at a lower end of the dispenser for alternately opening and closing a lower opening in the dosing chamber. The level of water in the toilet tank controls the movement of the valve head, and dispensing of the cleaner chemical controls movement of the floating shuttle. A grommet provides a valve seat for both the floating shuttle and valve head.

20 Claims, 31 Drawing Sheets

U.S. PATENT DOCUMENTS

| | | | | |
|---|---|---|---|---|
| 4,534,071 | A | | 8/1985 | Russomanno |
| 4,597,941 | A | | 7/1986 | Bottom et al. |
| 4,598,743 | A | | 7/1986 | Milling |
| 4,660,231 | A | | 4/1987 | McElfresh et al. |
| 4,663,786 | A | | 5/1987 | Kirkpatrick |
| 4,696,414 | A | | 9/1987 | Huat |
| 4,745,638 | A | | 5/1988 | Richards |
| 4,915,260 | A | | 4/1990 | Jones |
| 4,916,760 | A | | 4/1990 | Shahar |
| 4,924,921 | A | | 5/1990 | Simmel et al. |
| 5,038,417 | A | | 8/1991 | Bavavéas |
| 5,058,636 | A | | 10/1991 | Simmel et al. |
| 5,083,593 | A | | 1/1992 | Fogg |
| 5,090,443 | A | | 2/1992 | Jacobsen |
| 5,152,015 | A | | 10/1992 | Fourman |
| 5,259,423 | A | | 11/1993 | Simmel et al. |
| 5,353,957 | A | * | 10/1994 | Campau ..... 4/227.5 X |
| D365,138 | S | | 12/1995 | Puri |
| 5,488,742 | A | | 2/1996 | Liao |
| 5,505,236 | A | | 4/1996 | Grabenkort et al. |
| 5,551,095 | A | | 9/1996 | Chen |
| D376,840 | S | | 12/1996 | Perkins |
| 5,718,261 | A | | 2/1998 | Chen |
| 5,839,128 | A | | 11/1998 | Wang |
| 5,878,798 | A | | 3/1999 | Harris et al. |
| 5,896,887 | A | | 4/1999 | Edwards |
| 5,903,930 | A | | 5/1999 | Huang |
| 5,924,142 | A | | 7/1999 | Wang |
| 6,123,099 | A | | 9/2000 | Edwards |
| 6,212,692 | B1 | | 4/2001 | Hu |

FOREIGN PATENT DOCUMENTS

| | | | |
|---|---|---|---|
| GB | 420 701 | 12/1934 | |
| GB | 2007191 | 5/1979 | |
| GB | 2167041 | 5/1986 | |
| GB | 2182958 A | 5/1987 | ..... E03D/9/03 |
| GB | 2195368 A | 4/1988 | ..... E03D/9/03 |
| GB | 2287725 A | 9/1995 | ..... E03D/9/02 |
| GB | 2298878 | 9/1996 | ..... E03D/9/03 |
| WO | WO 83/01974 | 6/1983 | ..... E03D/9/03 |
| WO | WO 91/12382 | 8/1991 | ..... E03D/9/02 |
| WO | WO 99/08076 | 2/1999 | |

* cited by examiner

DOWN-STROKE DISPENSER

CROSS-REFERENCE TO RELATED APPLICATIONS

This is a continuation-in-part application claiming priority based on U.S. provisional application No. 60/290,047 filed on May 11, 2001.

STATEMENT REGARDING FEDERALLY SPONSORED RESEARCH/DEVELOPMENT

Not applicable

BACKGROUND OF THE INVENTION

This invention relates to dispensers used in bodies of liquid (particular water) where the liquid level rises and falls. It is particularly well suited to dispensers for cleaning and/or freshening such bodies of water, or containers downstream there from (such as a toilet bowl) which hold the treated water.

A variety of dispensers exists for automatically dispensing one or more chemicals into a water tank. See e.g. U.S. Pat. Nos. 5,924,142; 5,903,930; 5,839,128; 5,718,261; D376,840; 5,551,095; 5,488,742; D365,138; 5,152,015; 5,090,443; 5,038,417; 4,915,260; 4,696,414; 4,663,786; 4,660,231; 4,534,071; 4,429,809; 4,346,483; 4,285,074; 4,189,793; 4,101,043; 3,874,007; 3,778,850; 3,698,021; 2,587,388; and 1,602,554. See also GB 2,167,041; EP 1,026,331; and WO 99/08076. The disclosure of these patents and of all other publications referred to herein are incorporated by reference as if fully set forth herein.

However, such conventional automatic dispensers typically have disadvantages. For example, some have a tendency for the product being dispensed to leak out of the dispenser in an uncontrolled manner at some times, resulting in overdosing (and waste) of the product. Some do not provide adequate control over the amount of product that is dispensed when the water level changes. Still others do not provide the ability to release a cleaning and/or freshening agent so that it is retained in sufficient concentration in a toilet bowl after the flush (to prevent the majority of the active ingredients from being expelled along with the flush water). Moreover, some such dispensers which provide better performance are unduly expensive to produce, and thus are not practical for some applications such as home toilet bowl cleaning.

While a number of automated dispenser systems do use some type of float to follow the water level in a tank to help control the dispensing in response to water level changes, even such float systems have not successfully resolved all of the above concerns. Accordingly, there is a need in the art for an improved dispenser.

SUMMARY OF THE INVENTION

In one aspect the invention provides a dispenser for use in a tank that has a liquid level that rises and falls. The dispenser has a container, an adaptor for attachment to the container, a dosing chamber in the adaptor having therein a floating shuttle that can essentially seal a lower opening in the dosing chamber in one mode, and alternatively can float upwardly from that sealing mode, and a floatable valve head positioned outside the dosing chamber for alternately opening and closing the lower opening in the dosing chamber.

In preferred forms the container contains a dispensable product, and the product level in the dosing chamber can control the movement of the floating shuttle in the dosing chamber. There can also be a grommet that is not integral with the dosing chamber that is positioned adjacent the lower opening of the dosing chamber to form a valve seat for the floating shuttle. The grommet can provide a valve seat for the floatable valve head (for example, if the floatable valve head is hemispherical at its upper end the valve seat for the floatable valve head on the grommet can be essentially hemispherical in contour). In a particularly desirable form the grommet can be made of an upper layer of a first material and a lower layer of a second material different from the first such that the valve seat for the floating shuttle is of the first material and the valve seat for the floatable valve head is of the second material. This allows optimization of the softness of the valve seat for the upper layer, while permitting, the lower layer to be made of a material resistant to degradation.

In other forms there can be an air inlet into the container with an air pocket surrounding the air inlet. This prevents gurgling sounds when the product is being dispensed.

The floatable valve head can be surrounded by a reservoir. During a flush cycle water collects in the reservoir and then washes off the product from the valve head to avoid undesired build-ups or clogging.

The container can be a replaceable bottle. An opening in such a container can, after installation, have remnants of a seal that was pierced as the container was associated with the dispenser. When using this type of replaceable bottle, the adaptor preferably has a piercing element above the dosing chamber which pierced the seal. This permits a consumer to install a refill bottle without having the cleaner product splash or spill in an undesired manner. In other forms the container may be made of an essentially rigid plastic with a refilling port.

Alternatively, the container can be a flexible pouch. If so, this avoids certain concerns regarding venting as the container is emptied.

The product may be a liquid or flowable gel, but the shuttle should have a lower specific gravity than that of the product. In this regard, when the shuttle has a lower specific gravity than that of the product, after the valve head reseals the dispenser (at the end of the flush cycle when the toilet tank is refilled), the greater specific gravity of the product will cause it to bleed down into the dosing chamber below the shuttle, to cause the shuttle to float up. This creates an aliquot of product that is ready to be dispensed at the next flush cycle.

Liquid level in the tank will control the position of the floatable valve head relative to its valve seat. This in turn permits changes of product level in the dosing chamber, resulting in movement of the floating shuttle.

In another form the invention provides a method of cleaning a toilet having a water storage tank and a bowl. One inserts into the tank a dispenser comprising a container containing a dispensable product, an adaptor for attachment to the container, a dosing chamber in the adaptor having therein a floating shuttle that can essentially seal a lower opening in the dosing chamber in one mode, and alternatively can float upwardly from that sealing mode, and a floatable valve head positioned outside the dosing chamber for alternately opening and closing the lower opening in the dosing chamber.

The dispenser is configured and positioned such that water level of the tank controls the movement of the floatable valve head, and product level in the dosing chamber controls the movement of the floating shuttle in the dosing chamber. One then flushes the toilet.

For toilet bowl cleaners, any of the known flowable concentrated toilet bowl cleaning materials currently recommended for use in toilet tank water can be used, or others can be developed using surfactants, dyes, fragrances and/or other cleaning agents such as acids and chelating agents. For swimming pools, known flowable pool cleaning and/or water treatment chemicals can be used.

If the dispenser is installed in the tank, and the water level in the tank is at a specified filled level, the floatable valve head is designed to be driven up by the water to a position sealing the lower opening of the dosing chamber. This then allows the product level in the dosing chamber to rise even though the floating shuttle is moved up away from a sealing position. When the water in the tank is lowered or emptied (as would be typical when the toilet is flushed), the valve head will drop down away from sealing the lower opening of the dosing chamber, thereby allowing a dose of product in the dosing chamber to be released from the dispenser.

The dual float and the dosing chamber features of the dispenser help to accurately control the amount of product dispensed during each flush cycle. The fact that the product is delivered during the stage of the flush cycle when the water level is rapidly dropping helps insure that the product is delivered to the bowl at the latter part of the flushing cycle. Thus, most of the cleaner is not quickly flushed down the sewer with the waste. The concentration of cleaner in the bowl water and along the bowl sides between flushes is thus increased.

Further, the device is relatively inexpensive to produce. Also, it is designed so that a consumer can quickly install a refill without splashing or waste.

A more detailed understanding of these and other features and advantages of the present invention can be had by reference to the drawings and to the accompanying description, in which there are illustrated and described preferred embodiments of the invention.

BRIEF DESCRIPTION OF THE DRAWINGS

FIG. 3B shows the dispenser of FIG. 3A, but with a shrink-wrap closure removed, and a shipment cap in process of being disposed of;

DESCRIPTION OF THE PREFERRED EMBODIMENTS

Figure 1:
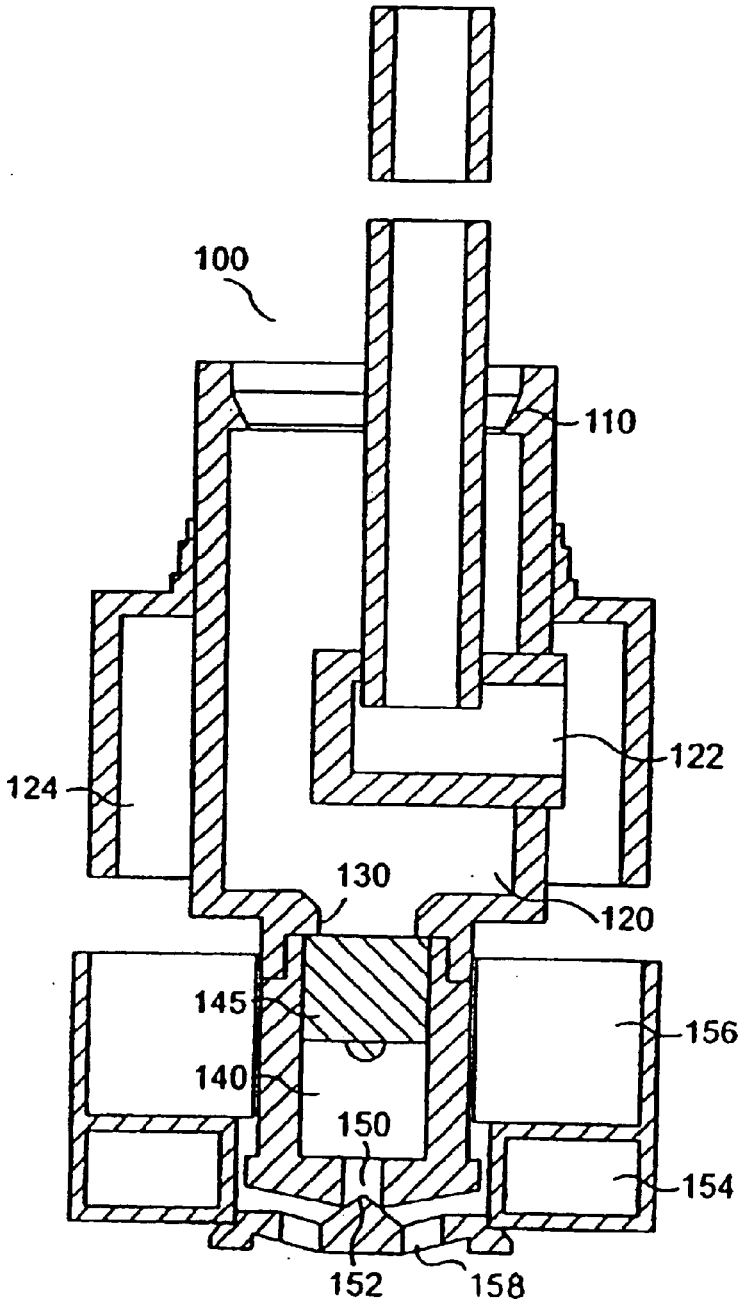
FIG. 1 is a schematic sectional view of the operational internal components of an in-tank dispenser according to the present invention, depicted as it would appear when the tank is full.
Figure 2:
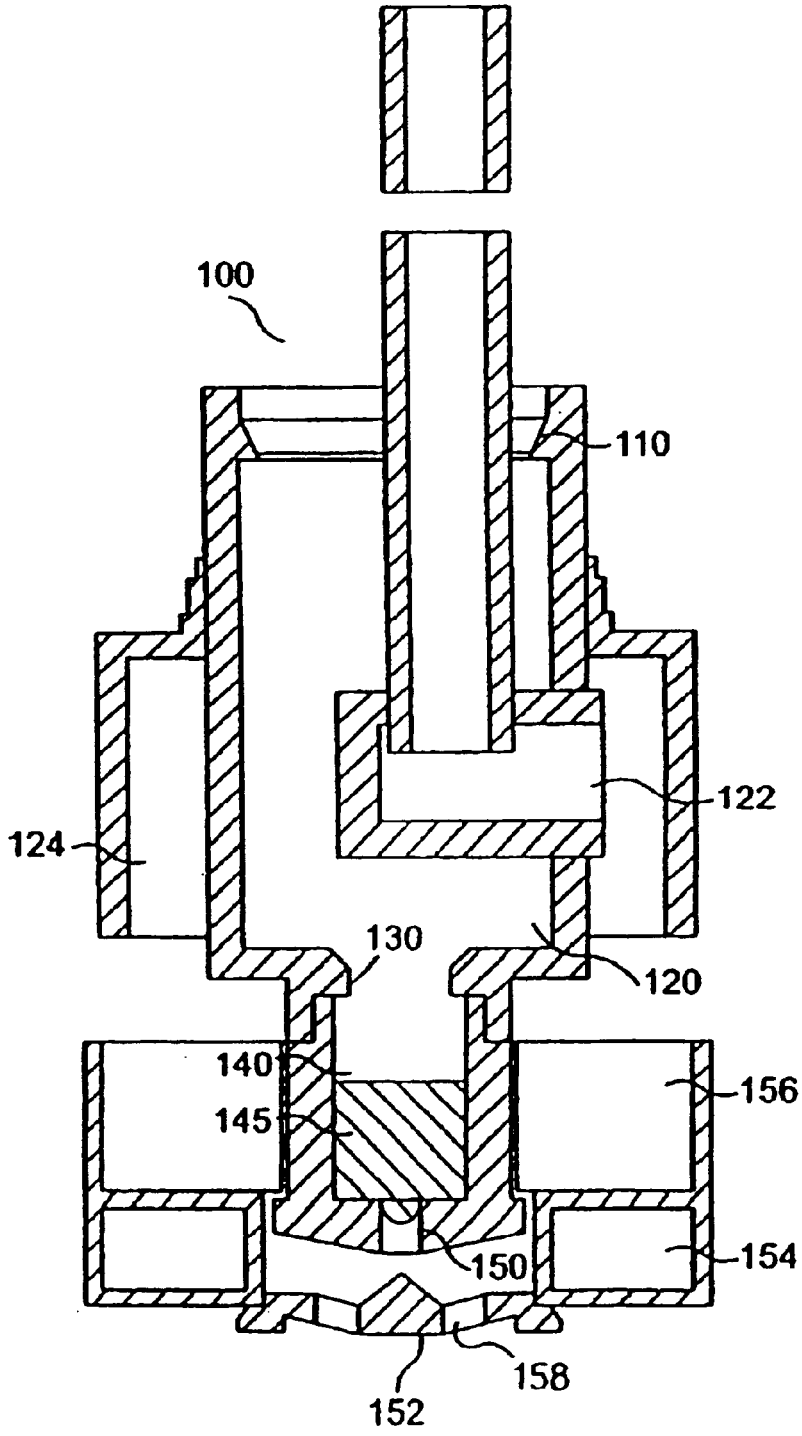
FIG. 2 is a view similar to FIG. 1 but showing a view as the device would appear when the tank is empty.
Figure 3C:
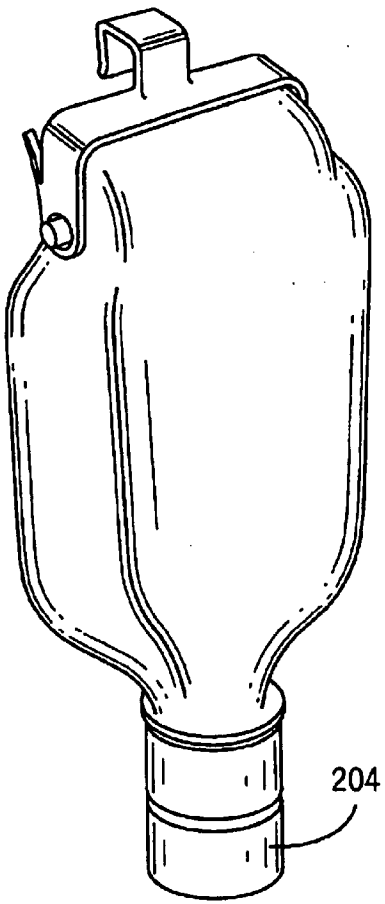
FIG. 3C shows the device of FIG. 3B, but inverted for use, with the adaptor fully installed, and with a mounting hook in a mounting position.
Figure 3B:
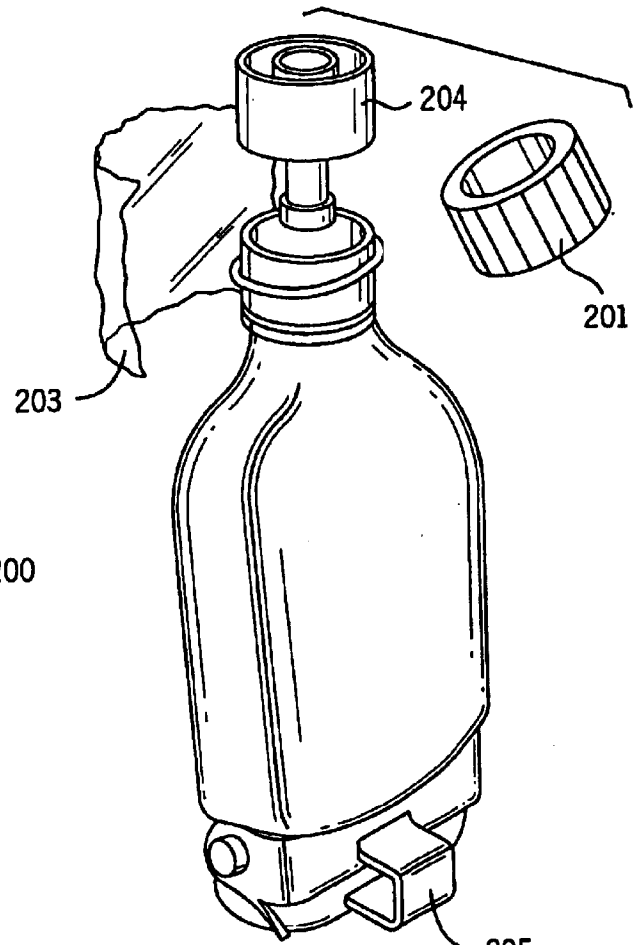
Figure 3A:
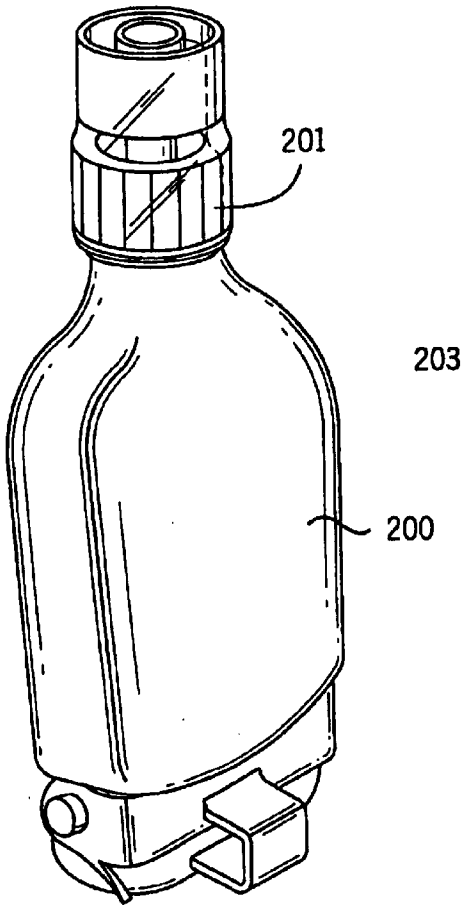
FIG. 3A depicts (in inverted fashion) a dispenser in accordance with the invention, as it would be supplied for retail sale.
Figure 3D:
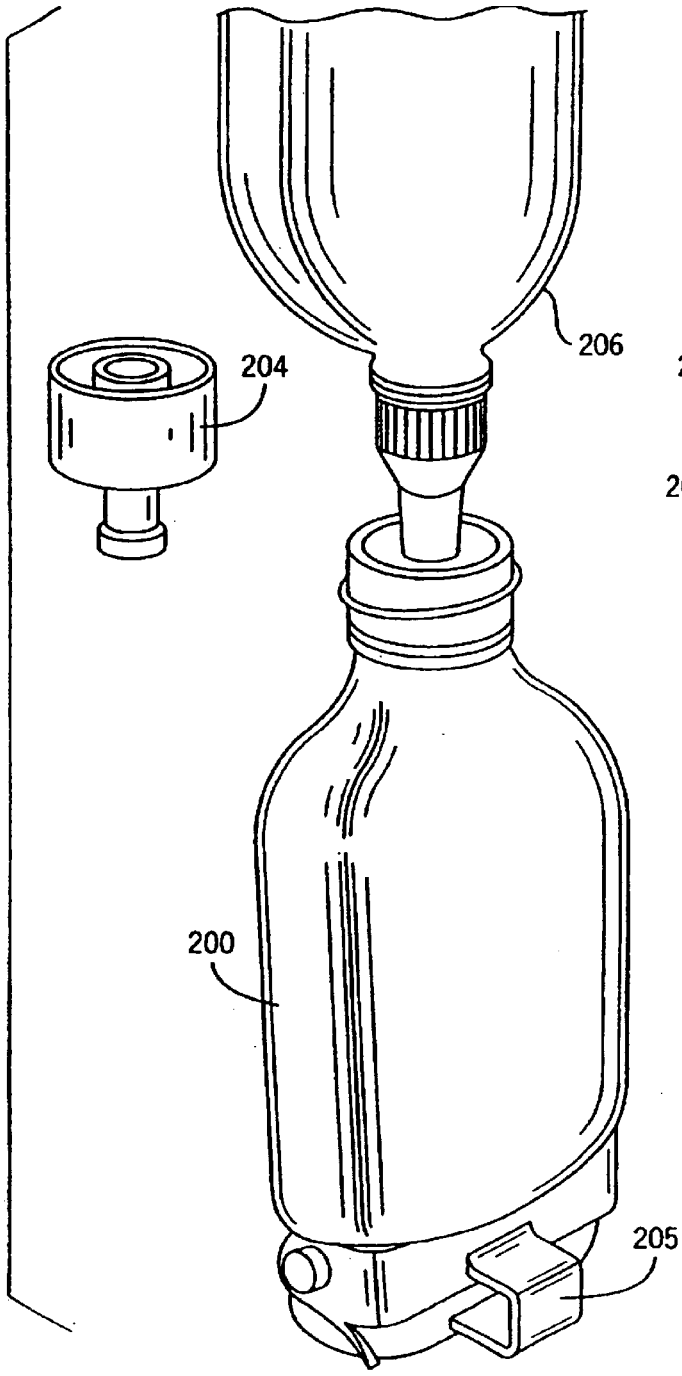
FIG. 3D is similar to FIG. 3B, but shows how such a dispenser can be refilled from a refill container 206.
Figure 3E:
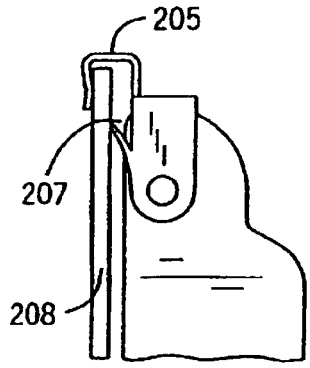
FIG. 3E is a schematic sectional view of the upper portion of FIG. 3C showing the dispenser mounted on a toilet tank wall.
Figure 3F:
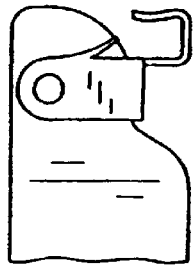
FIG. 3F is a view similar to FIG. 3E, but with the mounting device shown in its shipment position.

Referring to FIGS. 1 and 2, the in-tank adaptor 100 of this invention is formed from a durable material capable of withstanding prolonged immersion in water, and also capable of resisting the corrosive effects of the product it dispenses, such as polypropylene and/or acrylic. The cleaning and/or freshening agent according to the preferred embodiment is preferably a fluid, most preferably a liquid or a gel, and preferably has a viscosity of less than about 100 centipoise, more preferably less than about 30 centipoise, most preferably less than about 10 centipoise. The viscosity is greater than 0 centipoise.

The main adaptor part 110 allows the dispenser to fit onto a rigid bottle, flexible pouch, or other container having a dispensable product therein, and provides a watertight seal between the bottle and the dispenser using a snap fit, a threaded screw-on mechanism, or other tightly-sealing method of attachment.

The main adaptor part 110 preferably has a staging chamber 120 which fills with the product (e.g. a toilet bowl cleaner) once the main adaptor part 110 is fitted onto the bottle and inverted. The staging chamber has a narrowed neck portion 130 providing the lower boundary.

The neck portion 130 also forms the upper boundary of a dosing chamber 140, in which a defined quantity of product is readied for release into the body of water such as a toilet tank. The neck portion 130 is narrower than a floating shuttle 145 that is in the dosing chamber 140. The floating shuttle 145 is restricted from floating out of the dosing chamber 140 and into the staging chamber 120.

The bottom end of the dosing chamber 140 is defined by a valve outlet hole/lower opening 150, and the sides are set apart by a distance only slightly wider than the floating shuttle 145, so as to permit the shuttle 145 to move freely up and down within the dosing chamber 140.

The floating shuttle 145 is made of a material having a lower specific gravity than the product to be dispensed. As product passes past and under the shuttle, the shuttle 145 will float on the product within the dosing chamber 140 if the valve outlet 150 is closed. The specific gravity of the product is preferably less than about 25% higher than the specific gravity of the floating shuttle, more preferably less than about 15% higher, and is preferably greater than about 1% higher than the specific gravity of the floating shuttle, more preferably greater than about 5% higher. For example, the shuttle can be a hollow polypropylene shuttle having a specific gravity of about 0.9, and the product to be dispensed can be a liquid having a specific gravity of about 1.

The valve outlet hole 150 is primarily controlled by a movable external valve head 152, which is attached to a float 154. The valve head 152 opens and closes the valve outlet hole 150 in accordance with the level of water present in the tank, thereby allowing a dose of product to be released from the adaptor into the body of water. The valve outlet hole 150 may optionally have a seal surface comprised of polypropylene or acrylic, and more preferably it may have a soft seal comprised of silicone rubber. It should be noted that the external valve head 152 does not come into contact with the shuttle 145 in the preferred embodiment.

The preferred dispenser is designed to dispense metered doses of a product, ranging in volume from about 1 to about 10 milliliters. The volume of the dose depends on the capacity of the dosing chamber 140, which varies based on the length and diameter of the dosing chamber 140.

This adaptor 100 also includes an air inlet 122 that enters the adaptor 100 and continues up into the bottle or container of cleaning fluid. The air inlet 122 is surrounded by an air pocket 124 to prevent tank water from entering the adaptor 100. The air inlet 122 allows air to flow into the bottle to replace the amount of cleaning agent dispensed into the tank (and thus prevent gurgling sounds as the product is being dispensed).

Alternatively, if no air inlet is used in the adaptor, the dispenser may be vented by a vent opening in the top of the container that is always above the level of the water in the tank. If the vent opening is used, it is preferably sealed using a removable adhesive seal, a screw-on cap, or other seal means, before the container is inserted onto the dispenser for use. Various alternative ways of venting a container according to the present invention are shown in FIGS. 4A-4C, 5C-D, 6B, 8F, 9C, 10B, and 11E (these latter embodiments being discussed in more detail below).

The adaptor 100 may also optionally include a flush reservoir 156 on the float 154 for storing and releasing tank water to rinse away cleaning agent residue that may collect around the valve head 152. The flush reservoir 156 is preferably an open, annular chamber. The chamber may be subdivided using annular ribs (not shown).

The operation of this dispenser is as follows. A container of product is opened, and the dispenser is attached to the container via, for example, the sealing method of FIG. 1. As shown in FIGS. 12A-J, the container may include a breakable seal over the opening of the container. The seal may be formed from a metal foil, a plastic, or another material. The seal remains in place after the bottle cap is removed and the bottle is inverted.

The bottle can therefore be turned upside-down for insertion onto the dispenser without any leakage of the product contained therein. The seal is broken once the container is inserted onto the adaptor, because the adaptor is equipped with upwardly directed sharp projections for breaking the seal. After the seal is broken, fluid flows freely from the container into the adaptor.

The container, with the adaptor in place, is then inserted into, for example, a toilet tank with the adaptor 100 oriented so that the valve outlet hole 150 is directed downward. The system is designed to work best if, when the dispenser is mounted on the tank wall, most of the dispenser is submerged when the tank is at its normal fill level.

Product then flows down by the action of gravity from the container to the staging chamber 120, through the neck portion 130, and into the dosing chamber 140. When the dosing chamber 140 begins to fill with product, and begins to bleed downward along the sides and past the shuttle, the shuttle 145 begins to float on the product until it reaches the top of the dosing chamber 140, defined by the neck 130 of the staging chamber, which is narrower than the shuttle 145.

The valve head 152, attached to the float 154, is at its highest level when the toilet tank is filled. It is therefore fully engaged with the valve outlet hole 150, sealing it, and preventing the product in the dosing chamber 140 under the shuttle 145 from being dispensed into the toilet tank. If desired, the upper portion of the shuttle 145 can also be in the form of a seal, with a corresponding sealing seat formed on portion 130. However, it is not necessary that shuttle 145 seal against surface 130.

If the dispenser is equipped with flush reservoir 156, it is filled with water when the toilet tank water is high, as the water level in the tank is higher than the top edge of the reservoir 156. If an air inlet 122 is used, any product that entered the inlet when the adaptor 100 was initially attached and inverted has drained from the air inlet 122, and the surrounding air pocket 124 is filled with trapped air.

When the toilet is flushed, the water level in the tank decreases in the usual manner. As the water level decreases, the float 154 attached to the valve head 152 begins to drop, opening valve outlet hole 150. The product held in the dosing chamber 140 beneath the shuttle 145 rapidly flows out through the valve outlet 150 and through openings 158 around the valve head 152. As it does, the water contained in the flush reservoir 156 drains out, rinsing any product residue from the valve head 152.

As the product flows out of the dosing chamber 140 the shuttle 145 is able to drop via gravity to the bottom of the dosing chamber 140. In this position it acts to substantially seal off the outlet valve hole 150. In the absence of this, too much cleaner might be dispensed during a flush cycle.

The shuttle 145 remains at the bottom of the dosing chamber 140 until the valve head 152 rises as the level of water in the tank rises, sealing the outlet valve 150. This creates sufficient pressure in the valve outlet hole 150 beneath the shuttle 145 to cause the shuttle 145 to rise slightly in the dosing chamber 140. The product can then once again bleed past the sides of the shuttle and cause it to rise quickly within the dosing chamber 140.

As the dose of product is released, air travels into the container from the air inlet 122, replacing the volume of product that leaves the container as additional product passes from the container into the product chamber. If no air inlet is provided, then air may enter the container through the dispenser after the product is released into the body of water, and before the body of water rises and pushes the valve head 152 up to seal the valve outlet 150. Further, according to another optional embodiment, air may be vented through an opening in the top of the container that is above the highest level of the body of water.

It should be appreciated that as the float 154 rises, it pushes the valve head 152 into the outlet valve 150, sealing the dosing chamber 140 again. Also, as the water level rises, the optional flush reservoir 156 re-fills with water. As the water level continues to rise, air is trapped in the optional air pocket 124 surrounding the optional air inlet.

Importantly, by dispensing the product only as the water level in the tank is falling, the amount of product that remains in the body of water in the bowl is maximized. This action provides better cleaning efficiency. The dispenser according to our invention also reduces waste or leaking of product from the dispenser through the use of the double control system. The valve head 152 provides the main control. However, the shuttle 145 reduces the likelihood of more than a defined aliquot of cleaner being dispensed during a flush cycle.

Figure 4C:
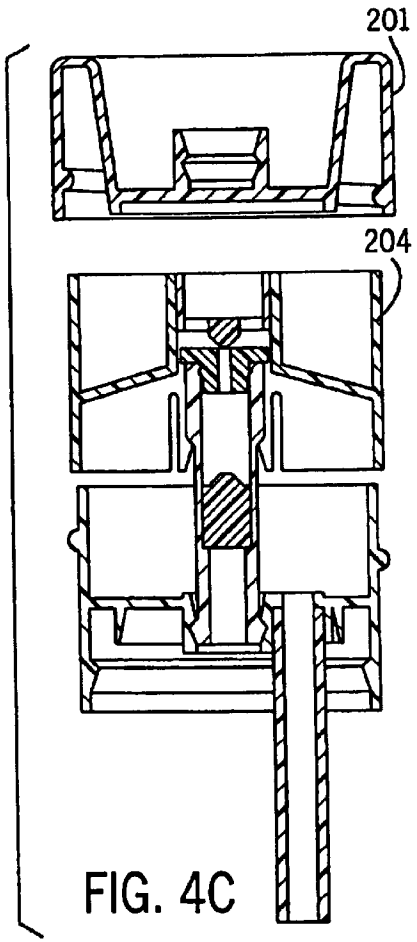
FIG. 4C depicts in sectional form the next stage of assembly after the FIG. 3B configuration.
Figure 4B:
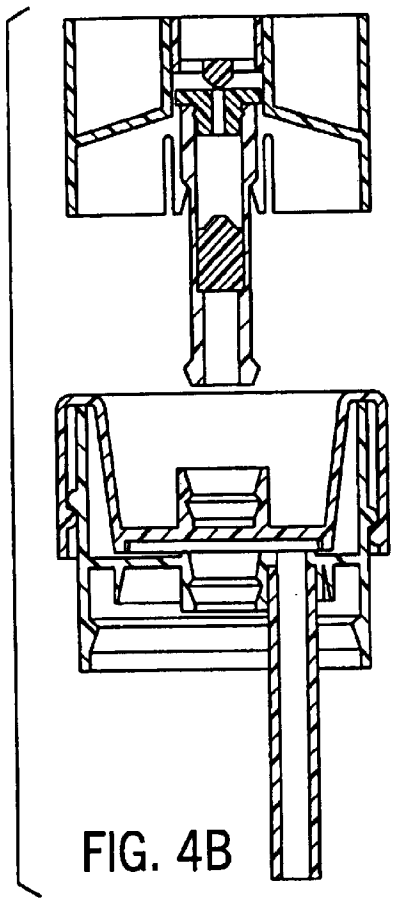
FIG. 4B depicts in sectional form how the dispenser parts are positioned in the FIG. 3B configuration.
Figure 4A:
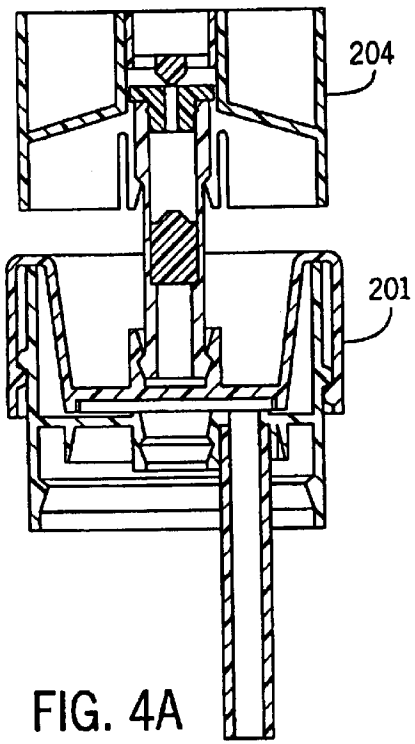
FIG. 4A depicts in sectional schematic form how the dispenser parts appear when assembled in the FIG. 3A shipment configuration.
Figure 5A:
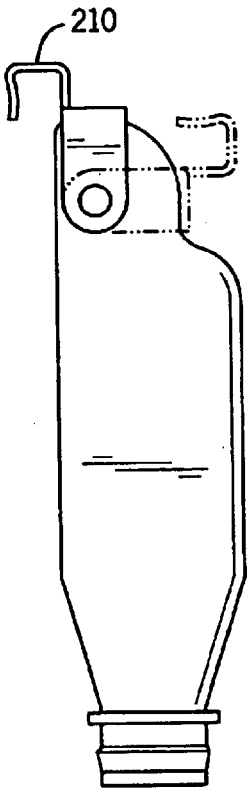
FIG. 5A is a side elevational view of a container for use with the dispenser system, with mounting device shown in two alternative configurations.
Figure 5C:
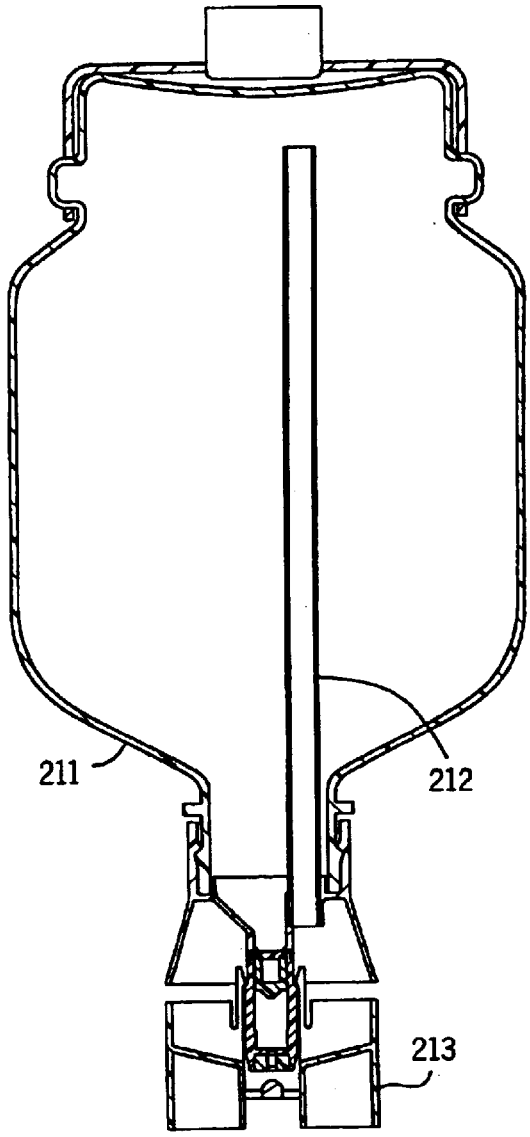
FIG. 5C is a vertical sectional view of the FIG. 5A device, albeit with an attached adaptor.
Figure 5B:
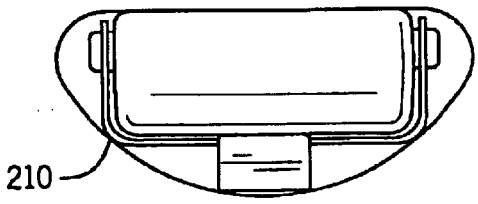
FIG. 5B is a top plan view thereof (with the mounting device in the storage position)
Figure 5D:
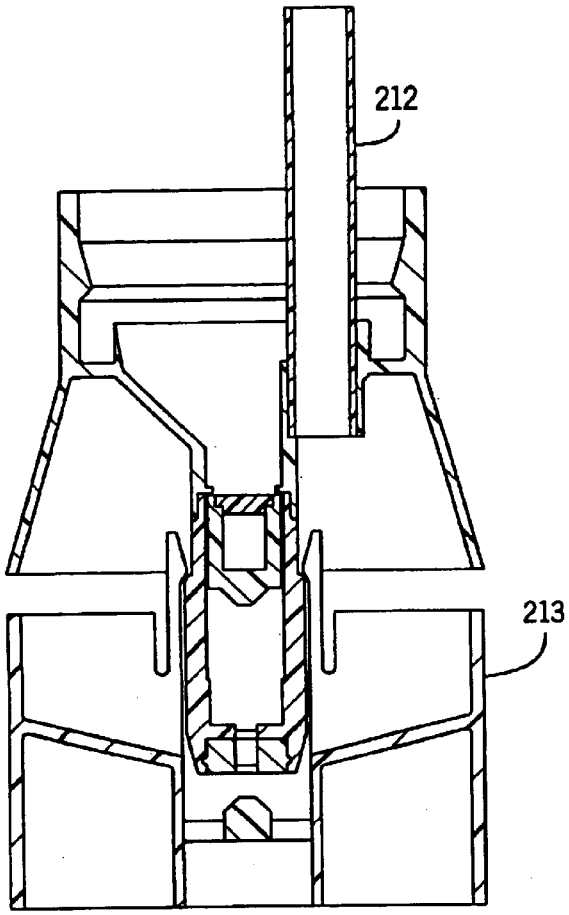
FIG. 5D is an enlarged view of the adaptor of FIG. 5C with dispensing airway.
Figure 5E:
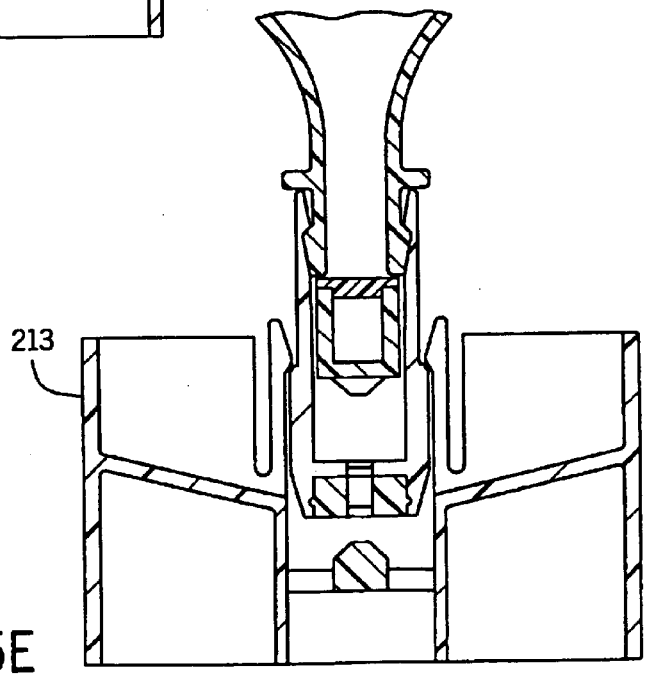
FIG. 5E is similar to FIG. 5D, but of an adaptor that doesn't have an airway.

Turning next to the following embodiments, it can be seen that the basic principles of the FIGS. 1 and 2 dispenser can be incorporated into a variety of different structures. As shown in FIGS. 3A-F there can be a plastic container 200 having a shipping cap 201 screwed on its upper mouth. A float valve 204 can be attached for shipment thereto by a shrinkwrap 203. Removal of the shrinkwrap permits the cap 201 and float valve 204 to be separated from the container 200 so that the cap 201 can be disposed of. The float valve 204 can then be inserted into the container 200 to provide the valve control, the container can be inverted, and the bottle can be hung from the pivotable hook 205. In a preferred form the hook has a tang 207 that adjusts for any differences in thickness of the toilet tank wall 208. FIGS. 4A-4B disclose how the FIG. 3A embodiment parts are internally connected during this process.

FIGS. 5A-E disclose a number of additional features. For example, the hook 210 can pivot into an upper recess on the bottle 211 for more compact storage. There can also be a vent tube 212 above the float 213 to minimize gurgling.

Figure 6C:
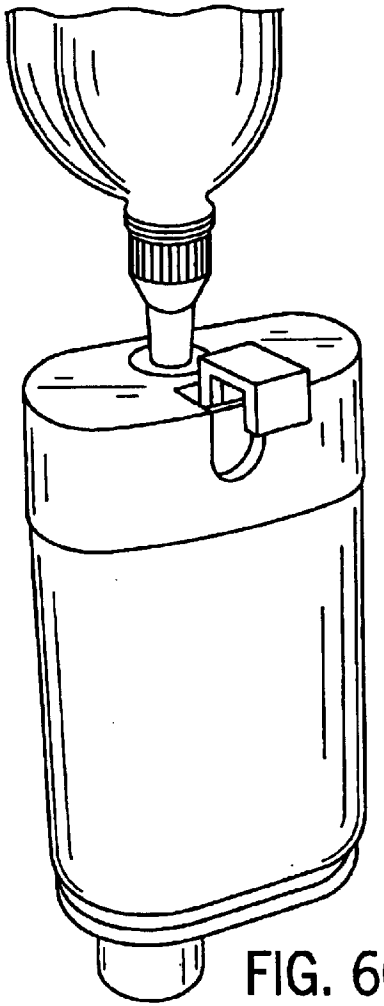
FIG. 6C is similar to FIG. 6B, but shows that the container of FIG. 6B could be refilled if desired.
Figure 6B:
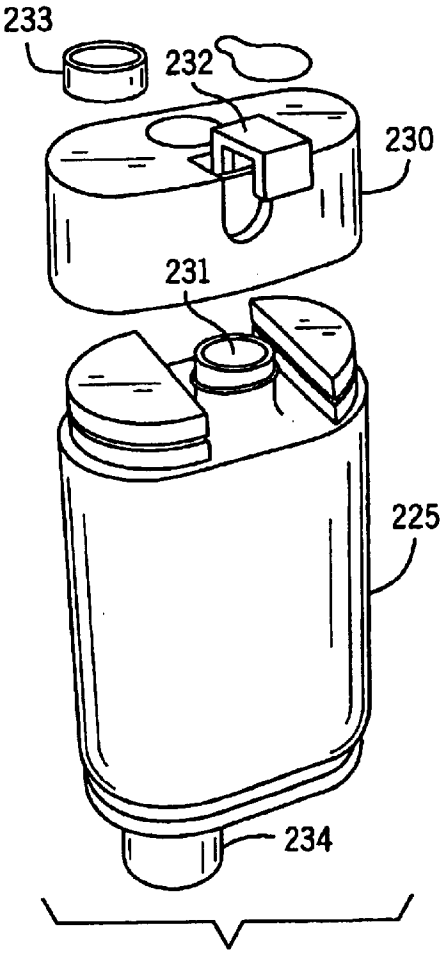
FIG. 6B is similar to FIG. 6A, but shows that the container can be of the removable type, and that the outlet need not be centered.
Figure 6A:
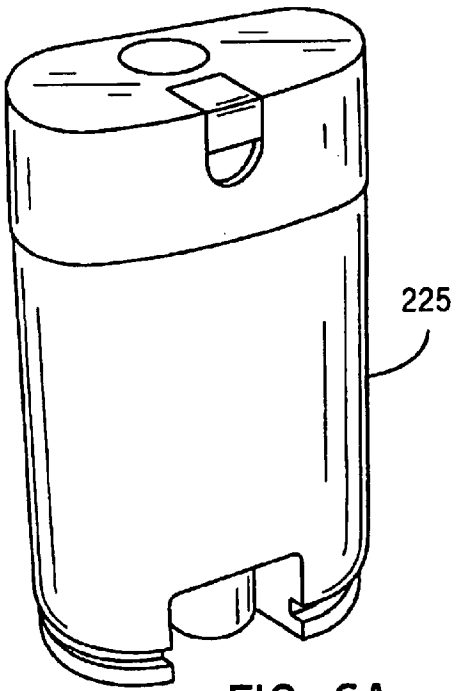
FIG. 6A illustrates a dispenser having a mounting hook that for storage can be axially positioned to be inset into a groove of the container.
Figure 7C:
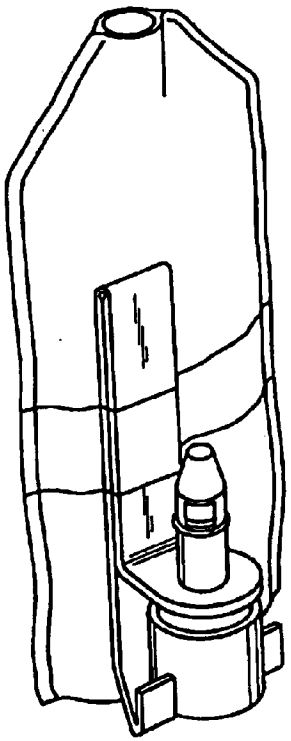
FIGS. 7A-7E illustrate that a flexible pouch can be the container, and if so how it would be configured for storage, and assembled for use.
Figure 7B:
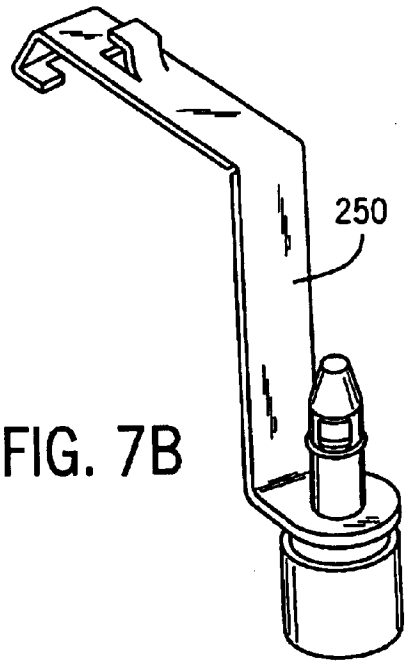
Figure 7A:
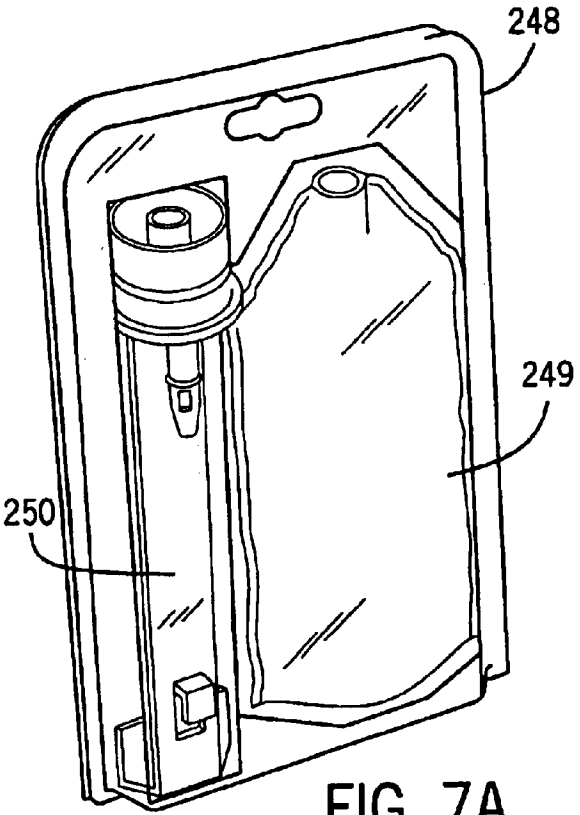
Figure 7D:
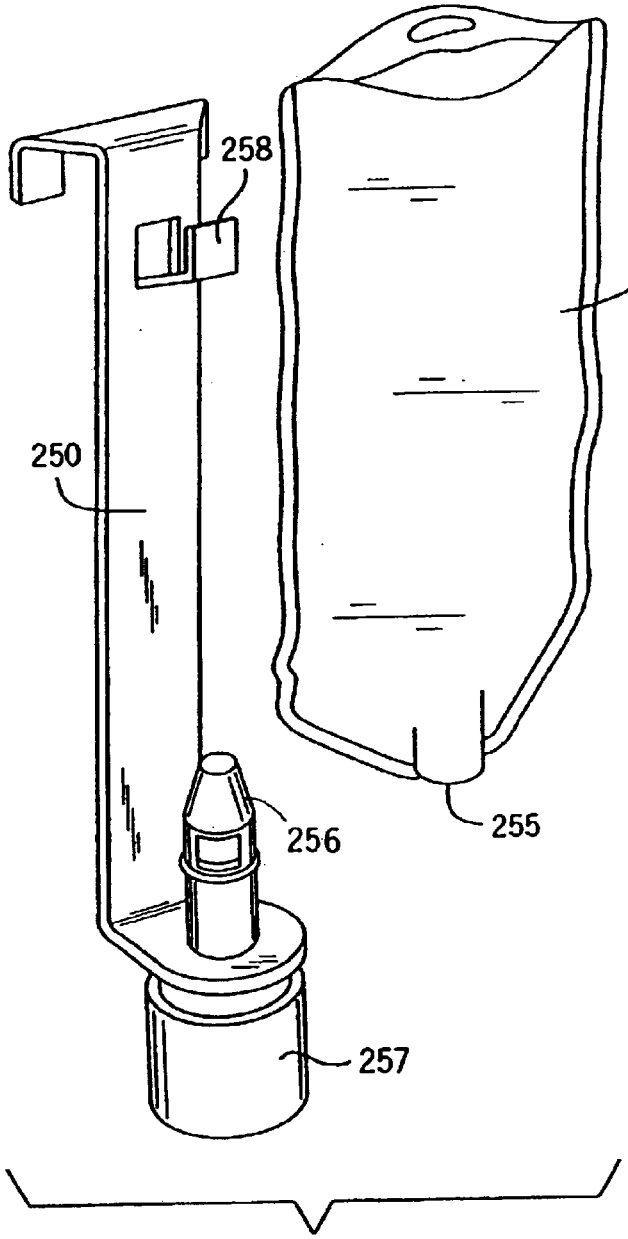
Figure 7E:
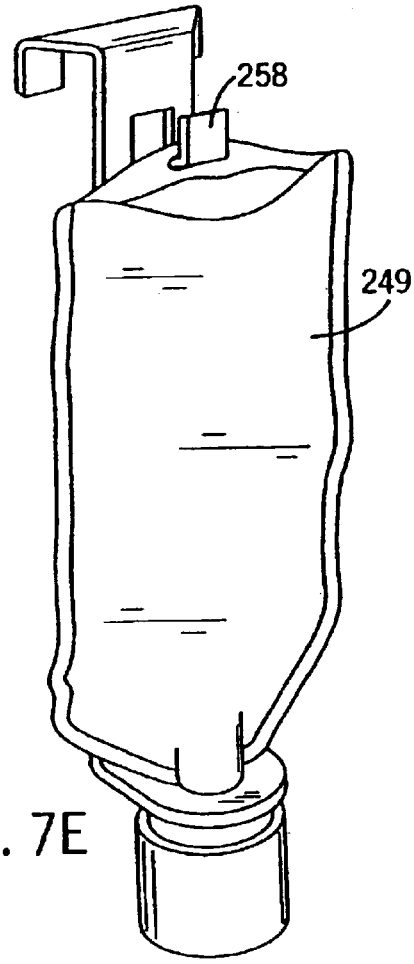

FIGS. 6A-6C disclose another bottle 225 having a lower outlet 234 to which a float control (not shown) can be attached. What is different about this embodiment is that there is an upper refill hole 231 accessible through a cap 230 and cover 233. This permits a single bottle to be used multiple times. There is also a retractable hanger hook 232.

FIGS. 7A-E show a collapsible pouch 249 which may be precharged with the cleaner. It has a lower opening 255 which fits on a valve projector 256 of hook 250. There is a prong 258 onto which the pouch may be hung to prevent it from drooping over. There is also a float 257. This embodiment is particularly desirable as it may be compactly packaged for shipment such as in clam shell 248.

Figure 8A:
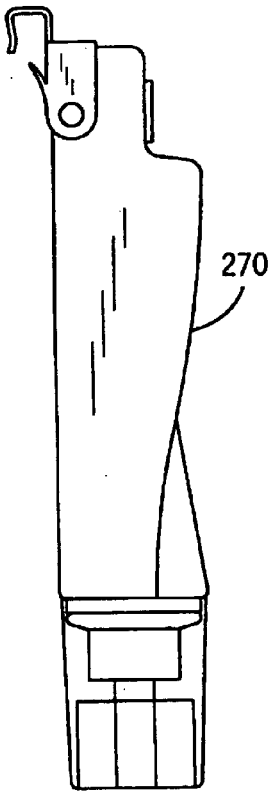
FIGS. 8A-8F illustrate various possible alternative external designs for the container, dispenser, and hanger.
Figure 8B:
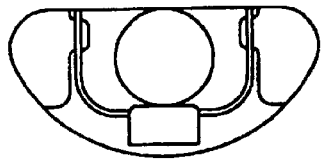
Figure 8C:
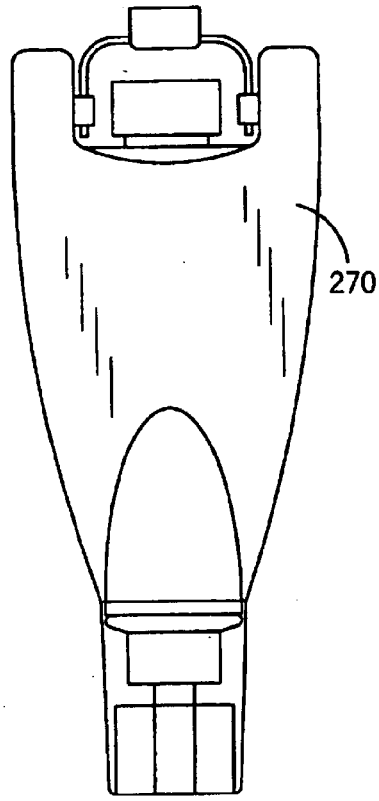
Figure 8E:
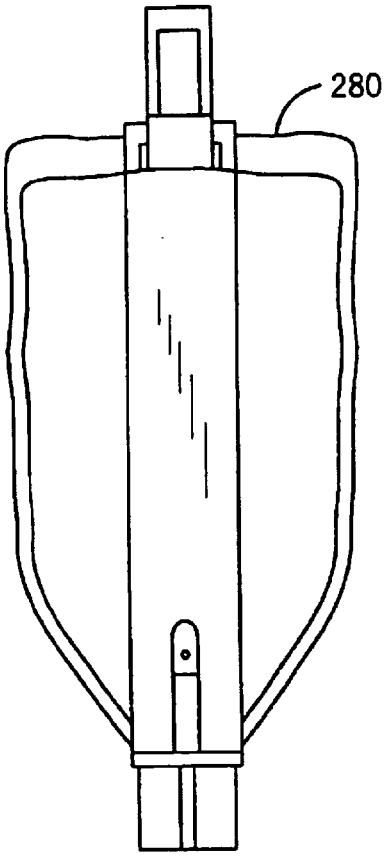
Figure 8F:
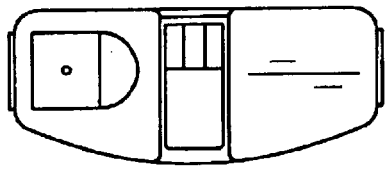
Figure 8D:
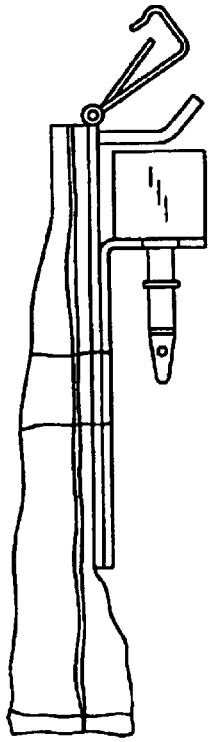
Figure 9C:
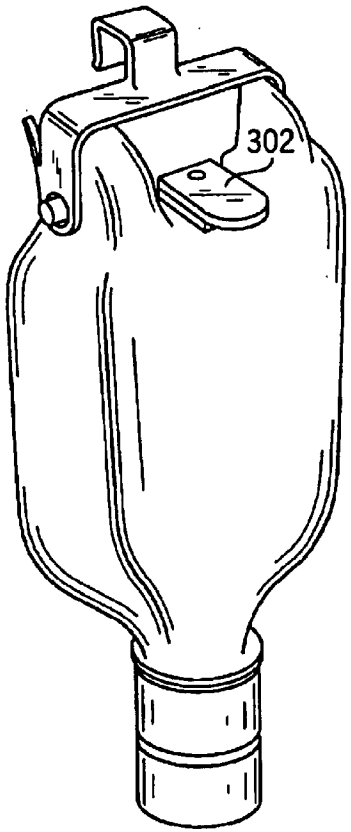
FIGS. 9A-9E illustrate a dispenser having a protective cap with a tear band closure, and show the hanging assembly and refill port hole.
Figure 9B:
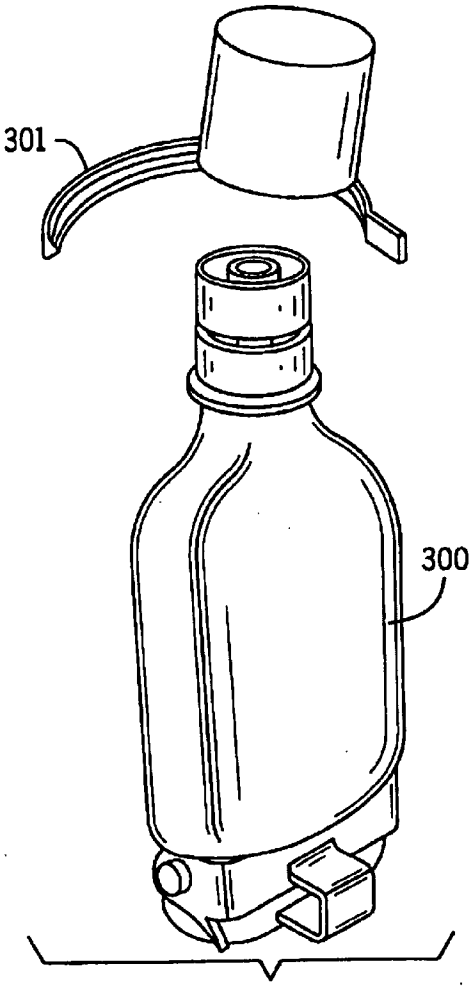
Figure 9A:
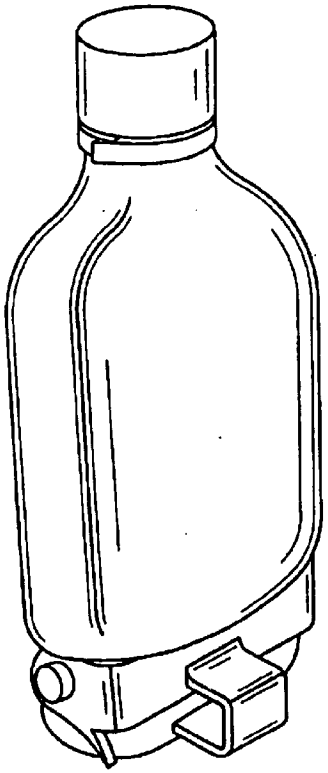
Figure 9E:
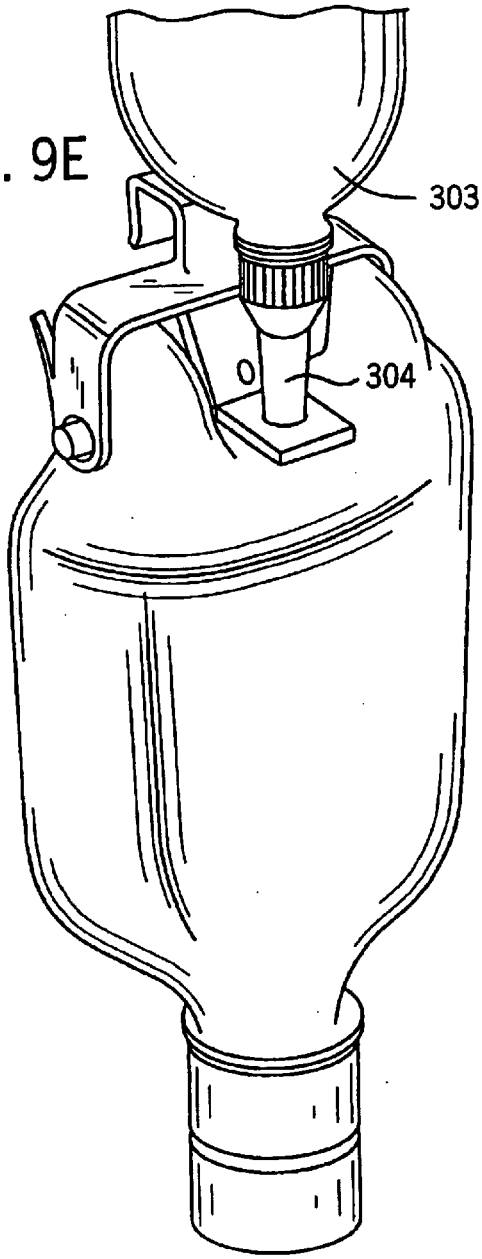
Figure 9D:
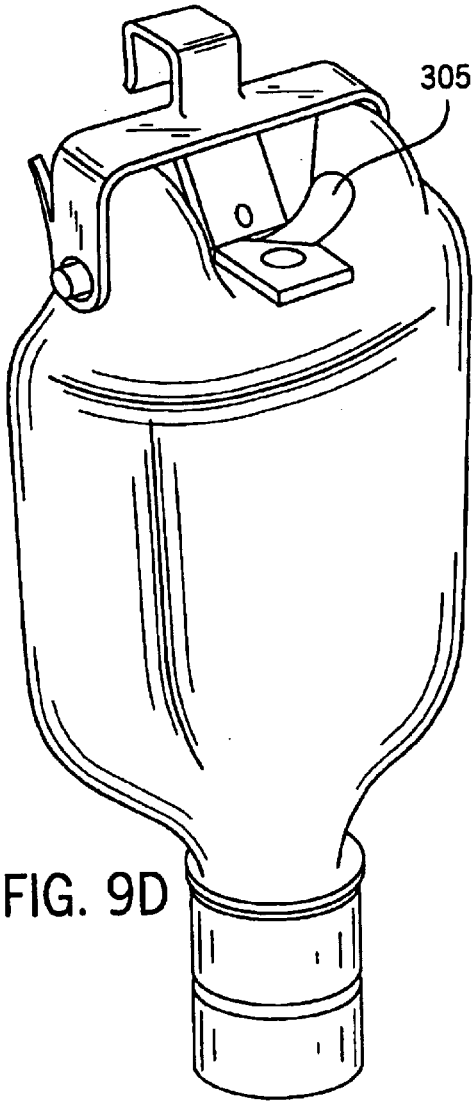

The embodiments of FIG. 8A-C (270) and FIGS. 8D-F (280) are of general interest for showing another mechanism for providing a pivotable hook. The latter embodiment also shows other storage techniques.

The embodiments of FIGS. 9A-9E is of interest for showing a bottle 300 having a tear-off band 301. The lower end of the bottle has a cover tab 302 which when lifted as at 305 permits a refill bottle 303 having an extension 304 to refill bottle 300.

Figure 10C:
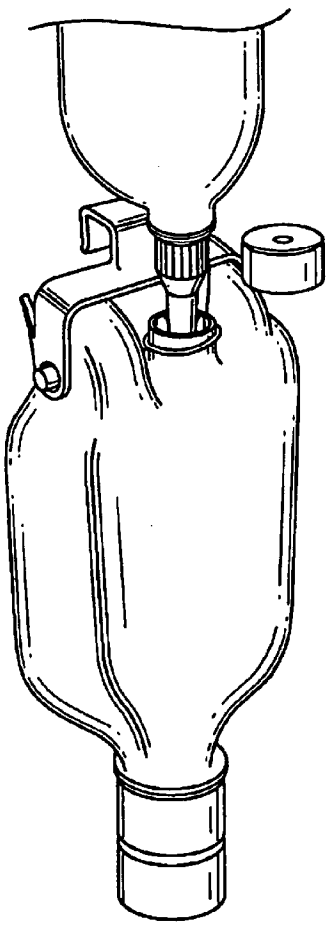
FIGS. 10A-10C illustrate a dispenser having a refill port covered by a screw cap and removable membrane.
Figure 10B:
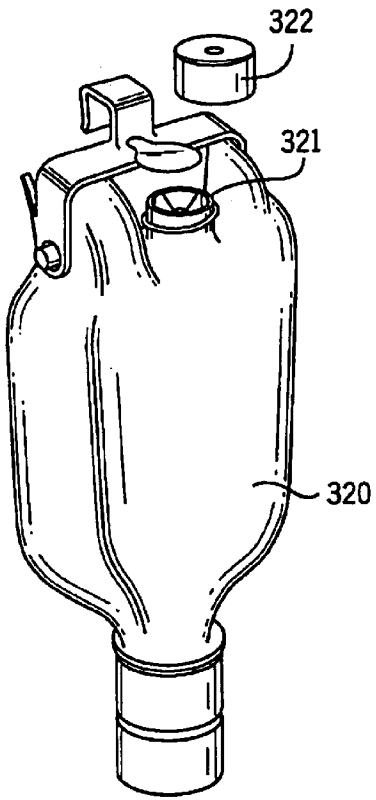
Figure 10A:
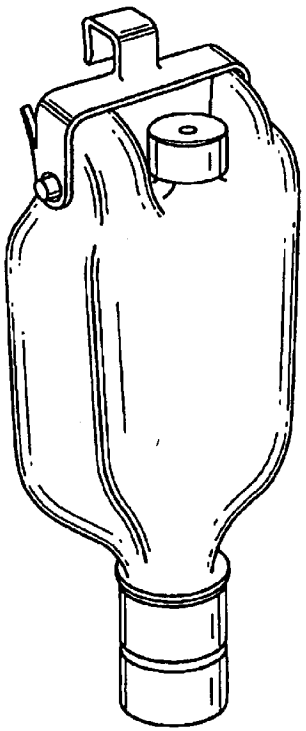
Figure 11C:
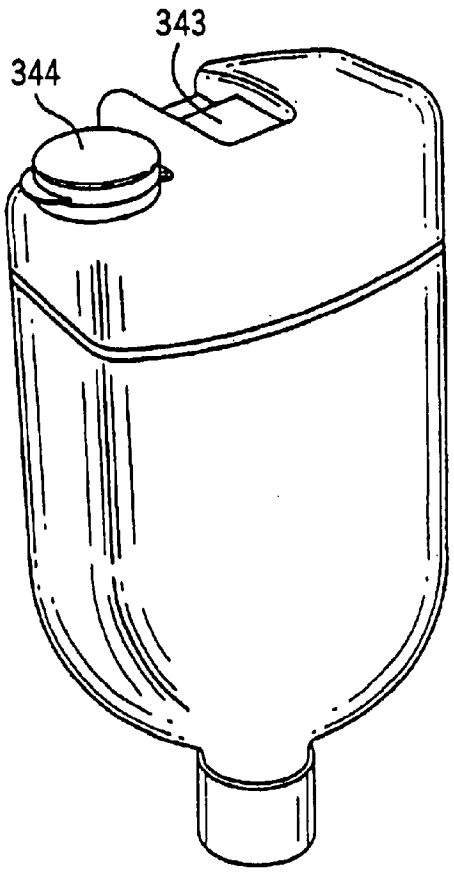
FIGS. 11A-11F illustrate a container with an incorporated dispensing device and hanger, in which the base of the container is affixed using a tear band that is removed by the consumer.
Figure 11B:
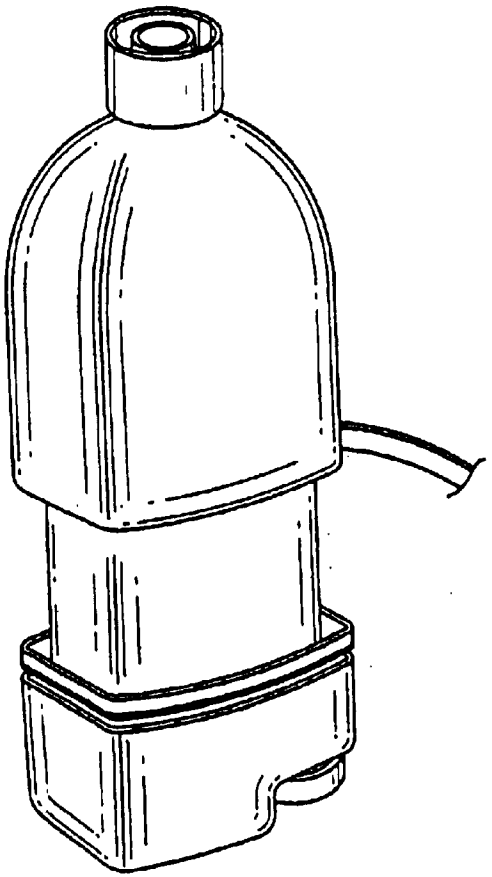
Figure 11A:
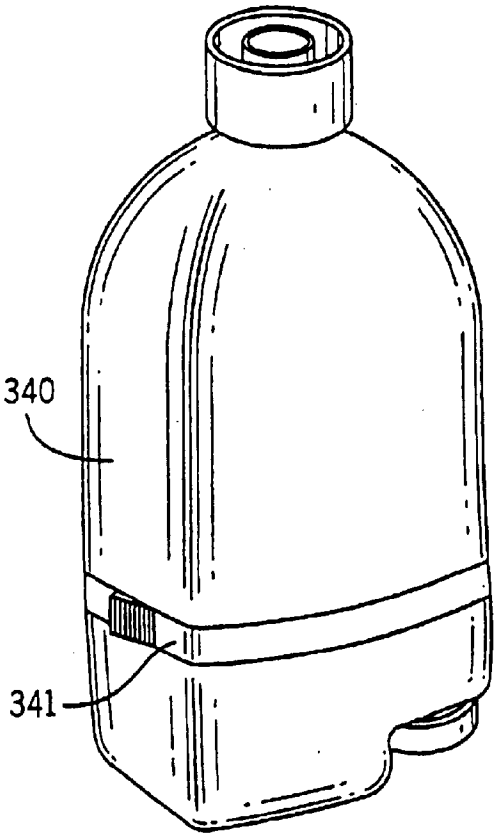
Figure 11F:
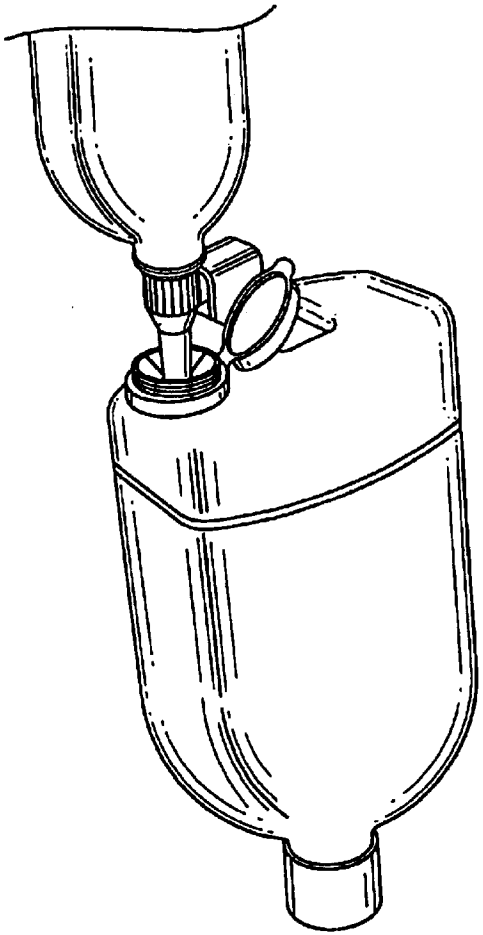
Figure 11E:
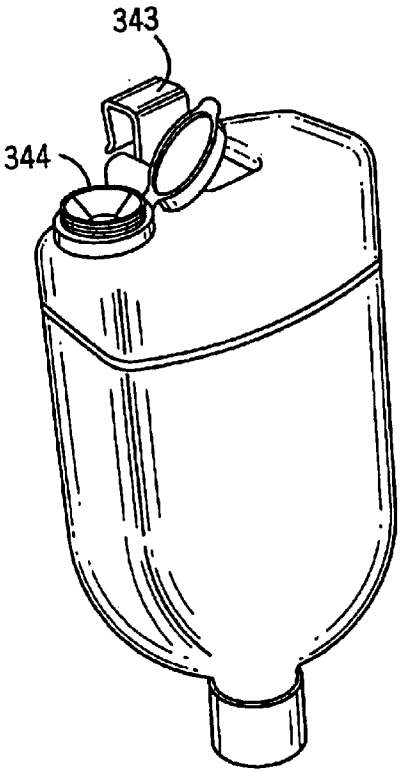
Figure 11D:
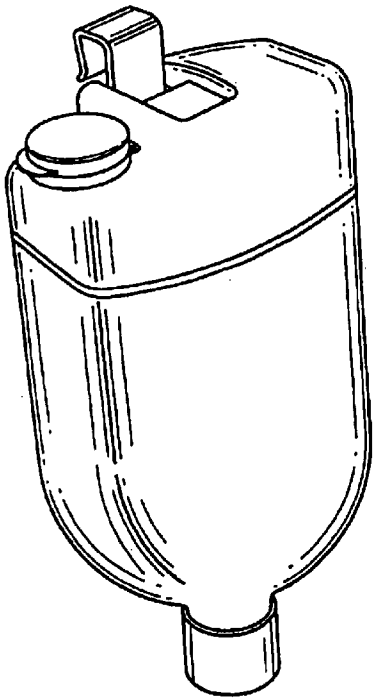

The embodiment of FIGS. 10A-C is of interest for showing a bottle 320 having a refill opening 321 with a screw-on cap 322.

The embodiment of FIGS. 11A-F is of interest for showing a bottle 340 with a tear band 341. Note the refill cap 344 and a retractable hook 343.

The embodiment 400 of FIGS. 12A-D is of interest for showing a particular configuration of a container 401, float 402 and a floating shuttle 403.

The embodiment 420 of FIGS. 12E-H is of interest for showing a particular hook 421 assembly.

Figure 12A:
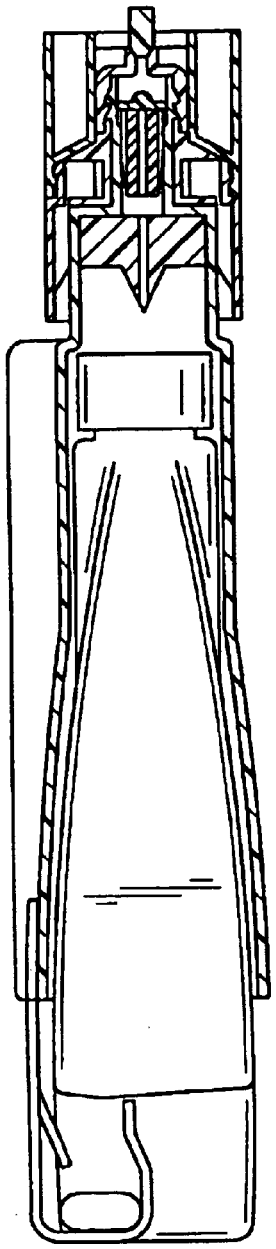
FIGS. 12A-12K are cross-sectional views of containers with incorporated dispensing devices and hangers, in which the dispensers include piercing devices, and the containers have pierceable membranes covering their opening.
Figure 12B:
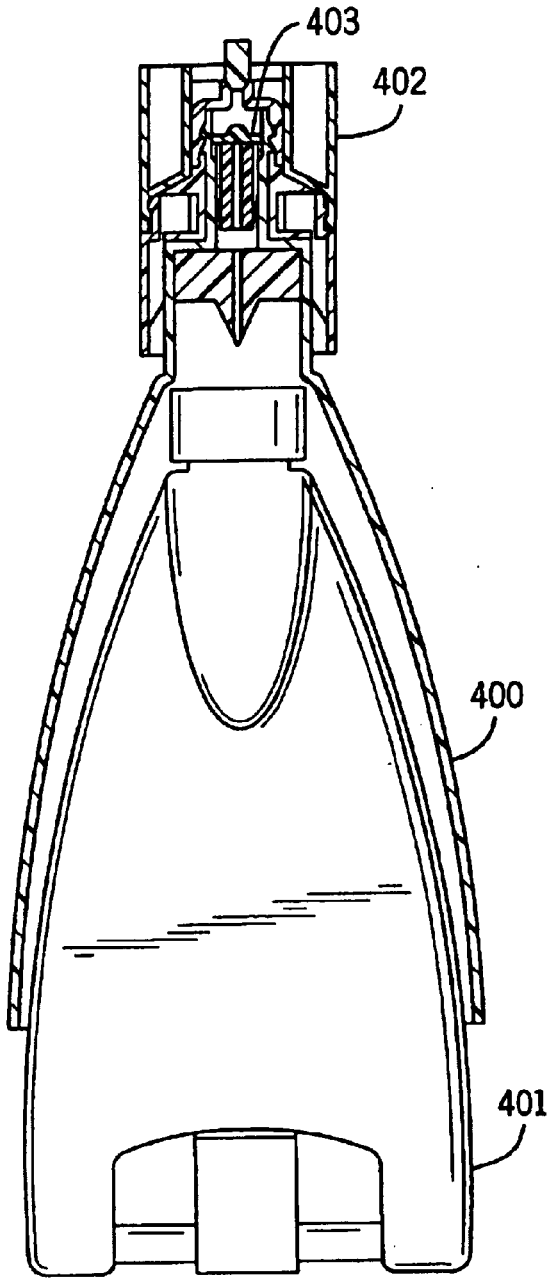
Figure 12C:
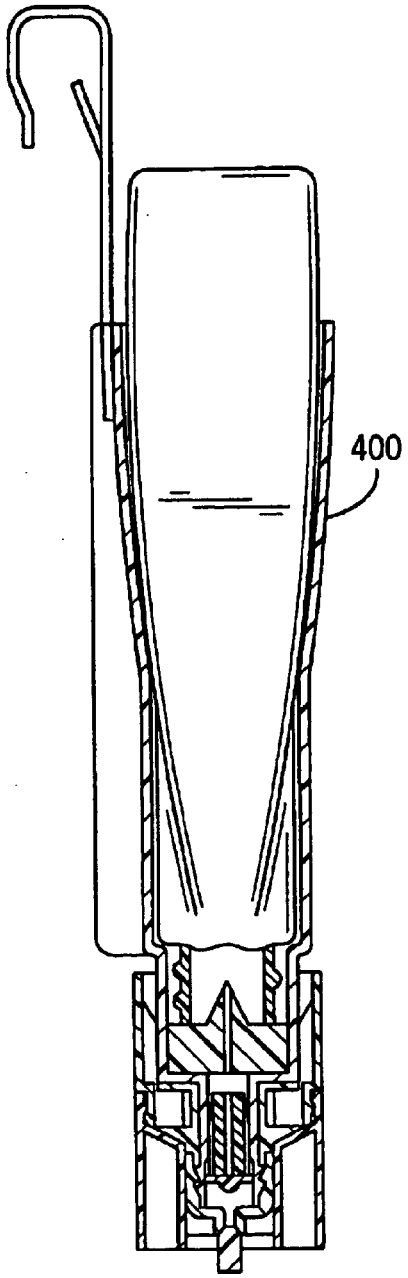
Figure 12D:
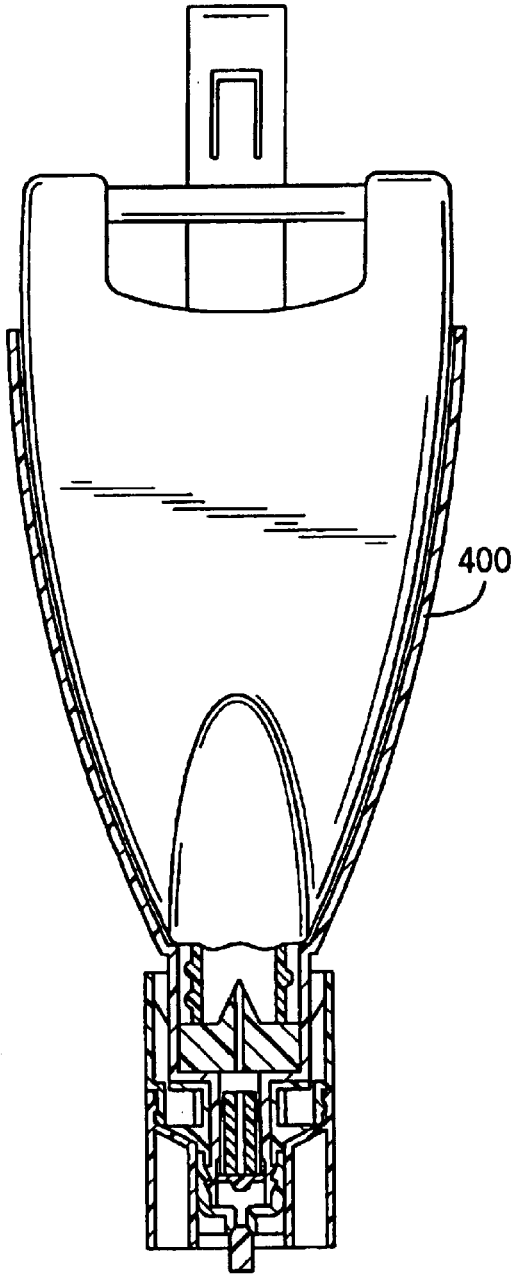
Figure 12E:
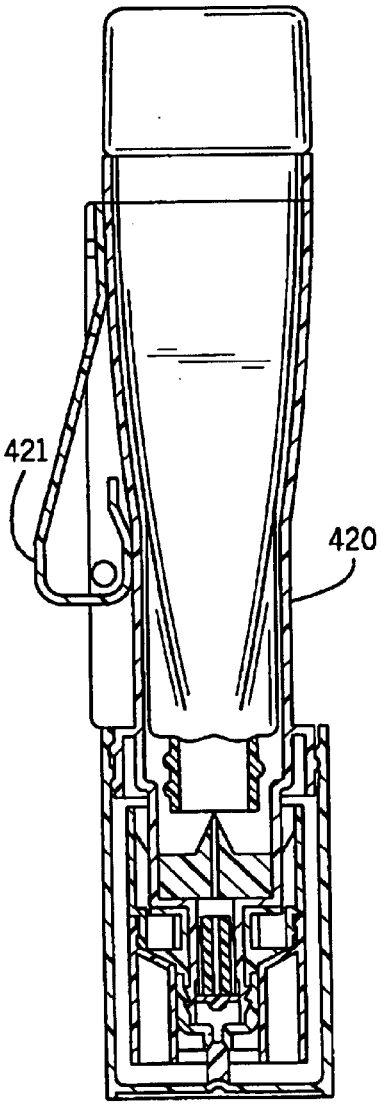
Figure 12F:
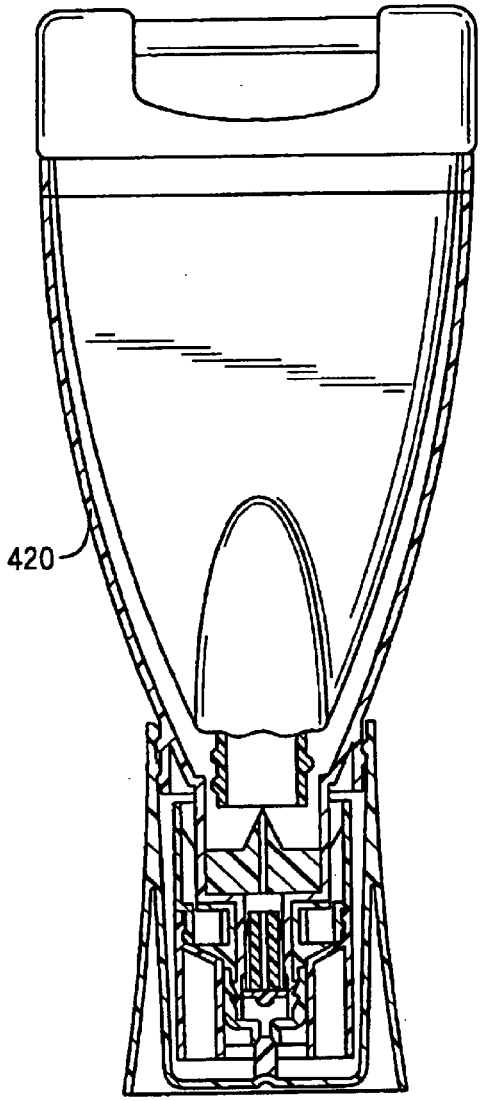
Figure 12G:
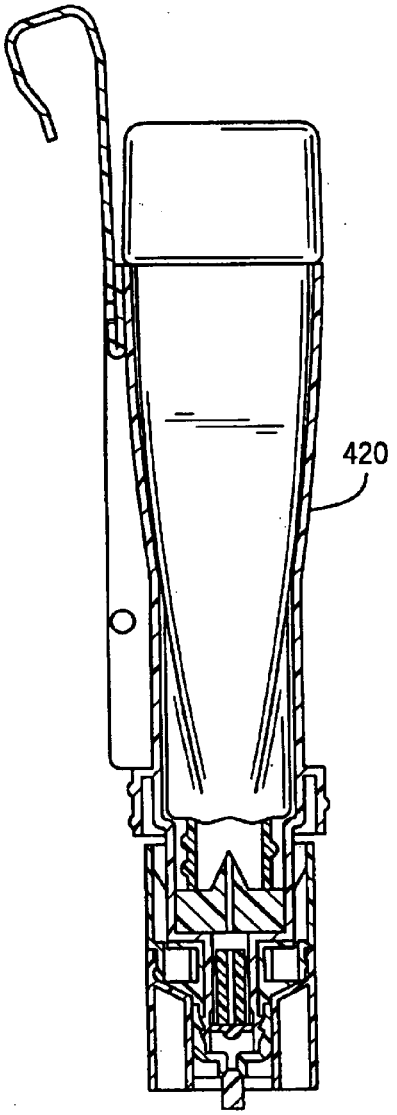
Figure 12H:
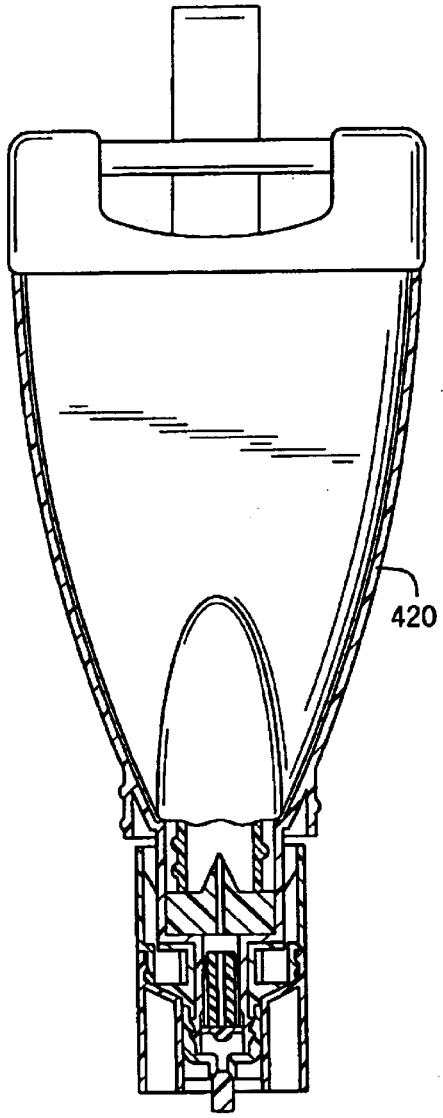
Figure 12K:
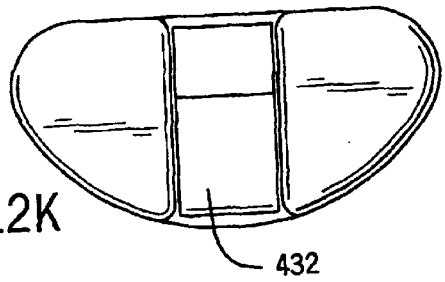
Figure 12I:
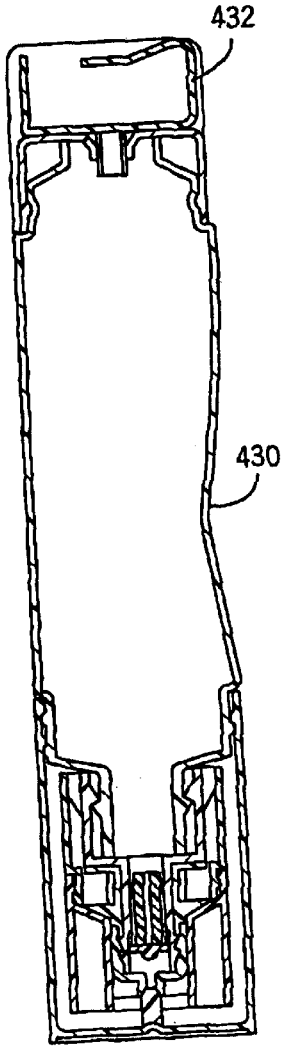
Figure 12J:
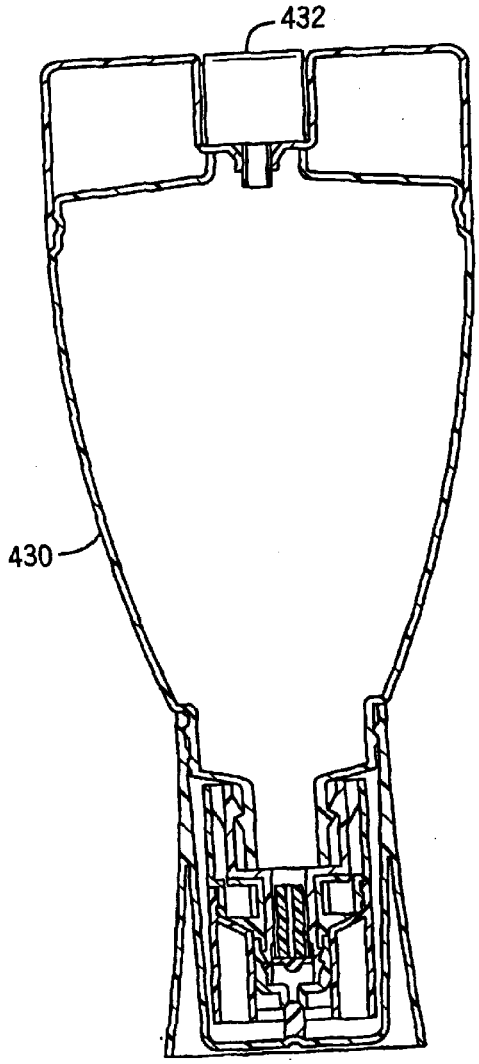

The embodiment 430 of FIGS. 12I-K is of interest for showing another hook assembly 432.

Figure 13A:
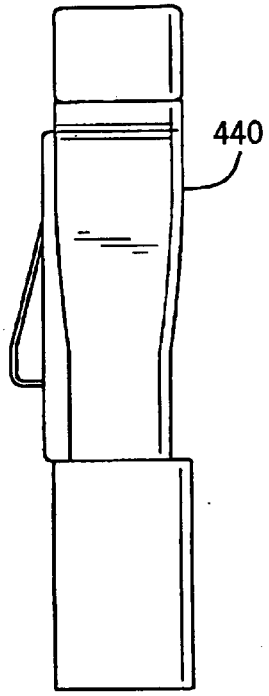
FIGS. 13A-13M illustrate containers with incorporated dispensing devices in their caps, and incorporated hangers.
Figure 13B:
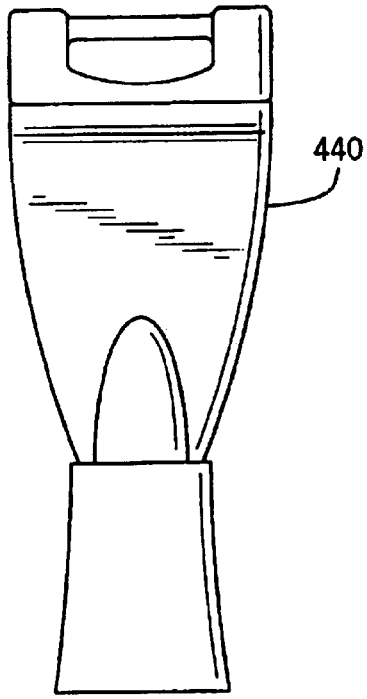
Figure 13C:
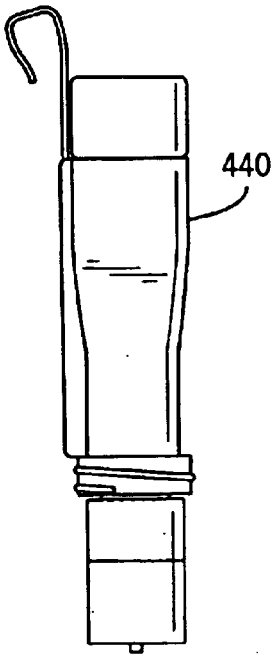
Figure 13D:
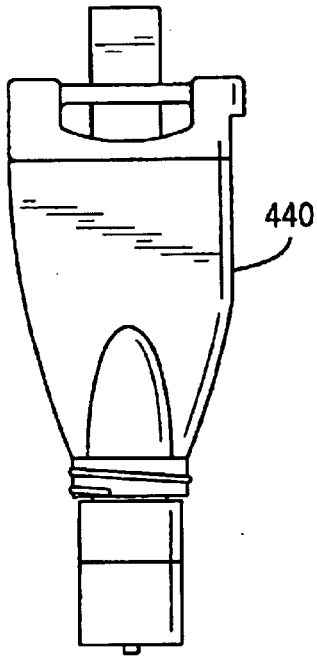
Figure 13G:
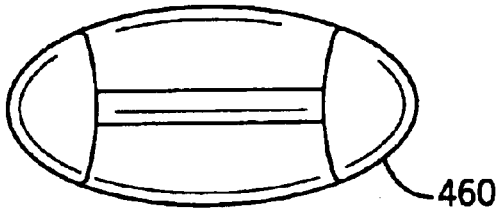
Figure 13E:
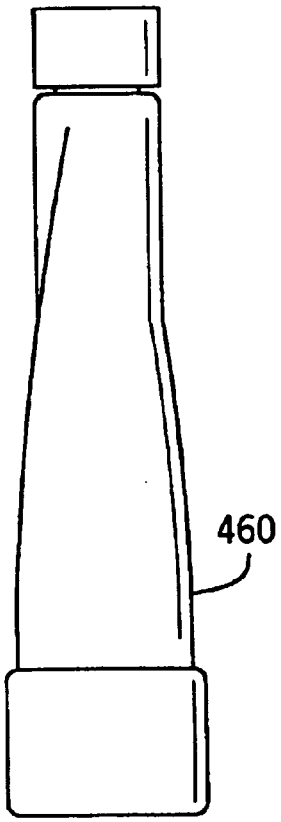
Figure 13F:
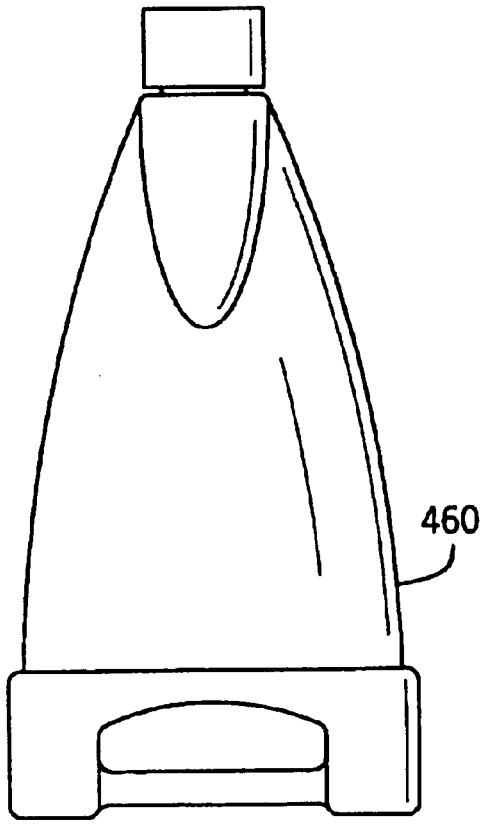

The embodiment 440 of FIGS. 13A-D is of general interest for showing additional ornamentation for the exterior of such a device. As noted in FIGS. 13E-G the refill bottle 460 may have a particularly sleek appearance.

Figure 13J:
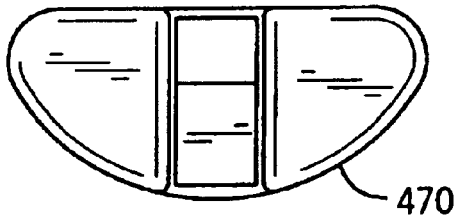
Figure 13H:
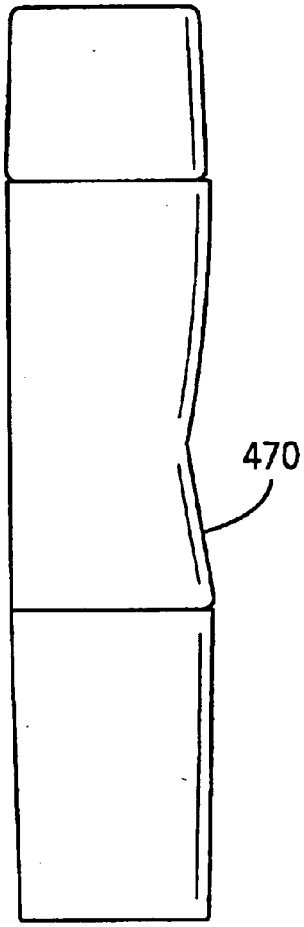
Figure 13I:
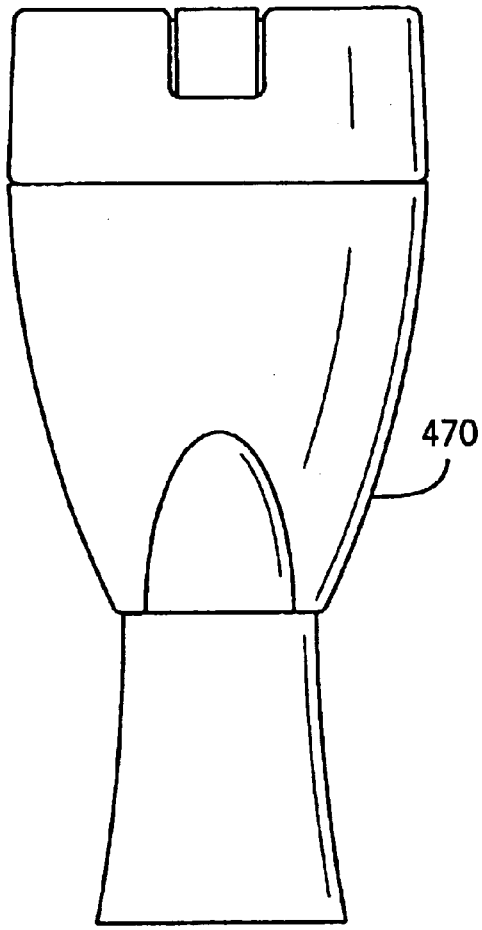

The embodiment 470 of FIGS. 13H-J shows another exterior ornamental appearance for a product of this type.

Figure 13M:
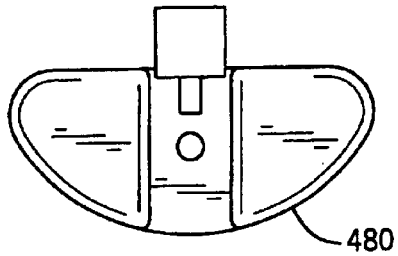
Figure 13K:
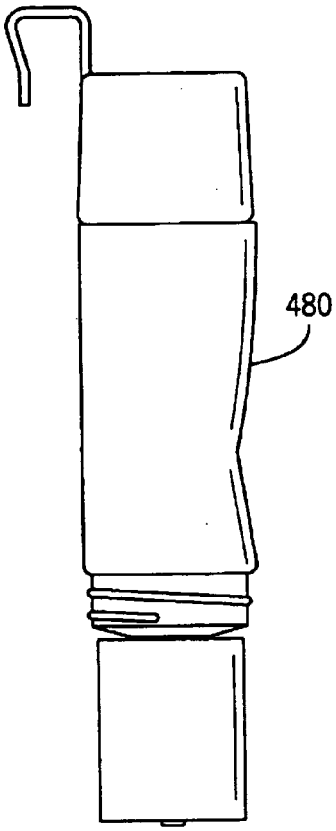
Figure 13L:
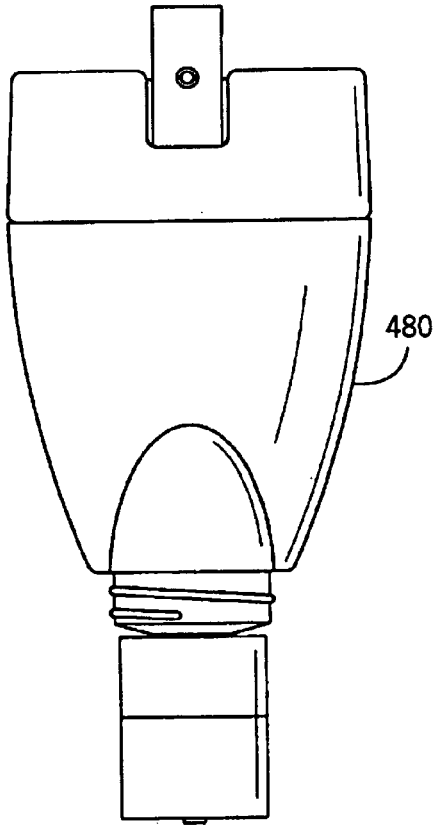
Figure 15:
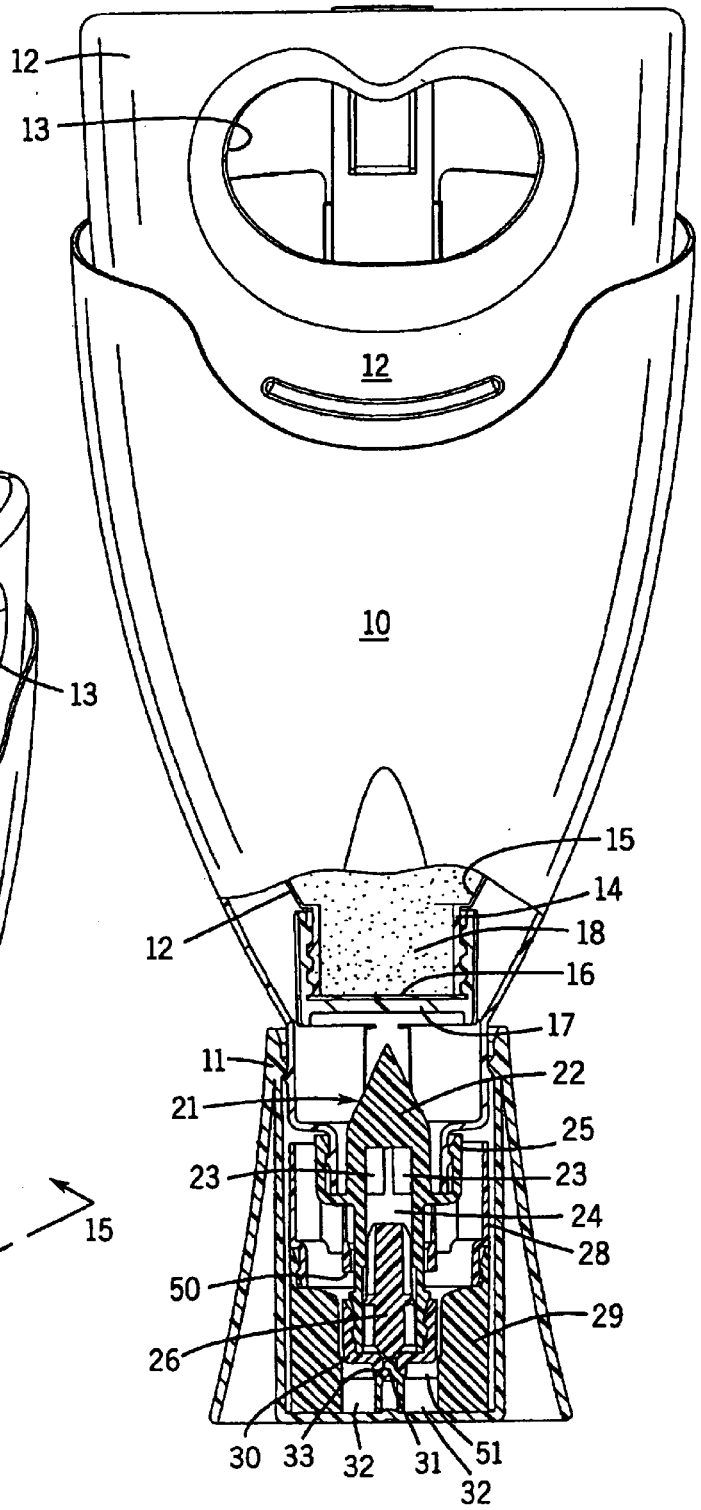
FIG. 15 is a front elevational view, partially in section, of the FIG. 14 device.

The embodiment 480 of FIGS. 13K-M shows yet another exterior ornamental appearance for a product of this type.

Where the container is refillable, then the container is preferably equipped with an opening that is above the highest possible level of the water in the tank, and allows the container to be refilled without removing the container and attached dispenser from the tank.

If the container is disposable, it may also optionally include a breakable seal over the outlet of the container. The seal allows the user to remove a protective cap from the container outlet, and invert the container for insertion onto the adaptor without spilling the liquid contained therein. In this form, the dispenser has a portion that is capable of piercing the breakable seal when the container is inserted onto the dispenser, allowing the fluid contained therein to exit the container. The breakable seal may be formed of a plastic or foil (for example, aluminum foil), or other suitable substance. The portion of the dispenser that pierces the seal may have a sharp or pointed end.

Figure 14:
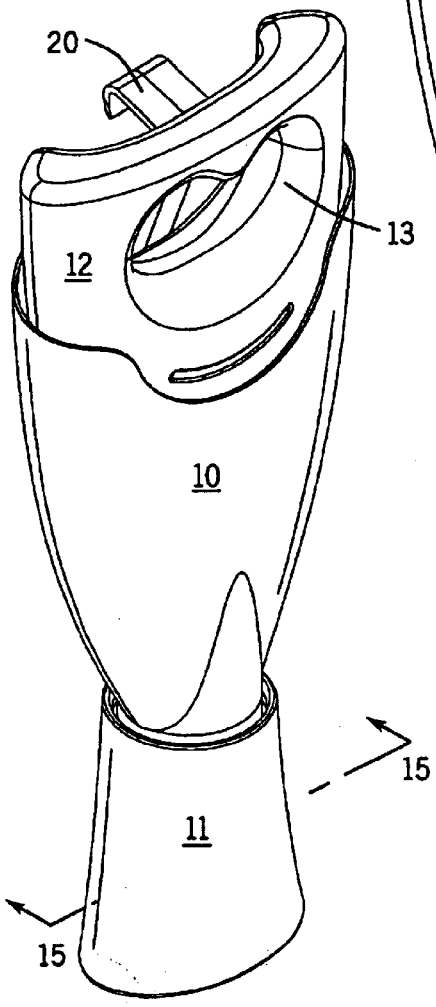
FIG. 14 is a perspective view of the most preferred dispenser of the present invention (in the configuration it would appear during shipment or storage outside of a toilet tank prior to use)

Turning now to one of the two most preferred embodiments, FIG. 14 depicts a holster 10, a stand 11, and a removable bottle 12. Preferably the bottle has a cut out 13 to provide a hand grip area and a mouth 14. There is the usual cavity 15 inside the bottle that can be filled with a selected chemical cleaner.

For shipment a pierceable aluminum foil seal 16 is adhered to the mouth of the bottle, and a cap 17 removably closes the bottle via the usual threads. The holster 10 is provided with a hook 20 for mounting on a toilet tank wall or the like (not shown).

There is also an adaptor (generally 21) that has a piercing member 22 that has an upper pointed portion, side openings 23 and a central axial bore 24. Collar 25 is designed to snap onto a lower end of the holster 10.

Shuttle 26 is inserted in the central axial bore 24. A first float part 28 is then positioned around the central section of the piercing member. A cap 30 snaps onto the bottom of the piercing member to trap the first float part. A second float part 29 is then snapped onto the first float part 28. It should particularly be noted that the second float part 29 has a valve head 31 as well as a passageway 32 beneath it that can be reached when the head is not sealing an outlet hole 33 in the cap 30.

The product is purchased in the form shown in FIG. 14. A consumer snaps off the protective stand 11, temporarily removes the bottle 12 from its holster, screws off the cap 17, gently replaces the bottle in the holster, and hangs the assembly on a tank wall.

Figure 16:
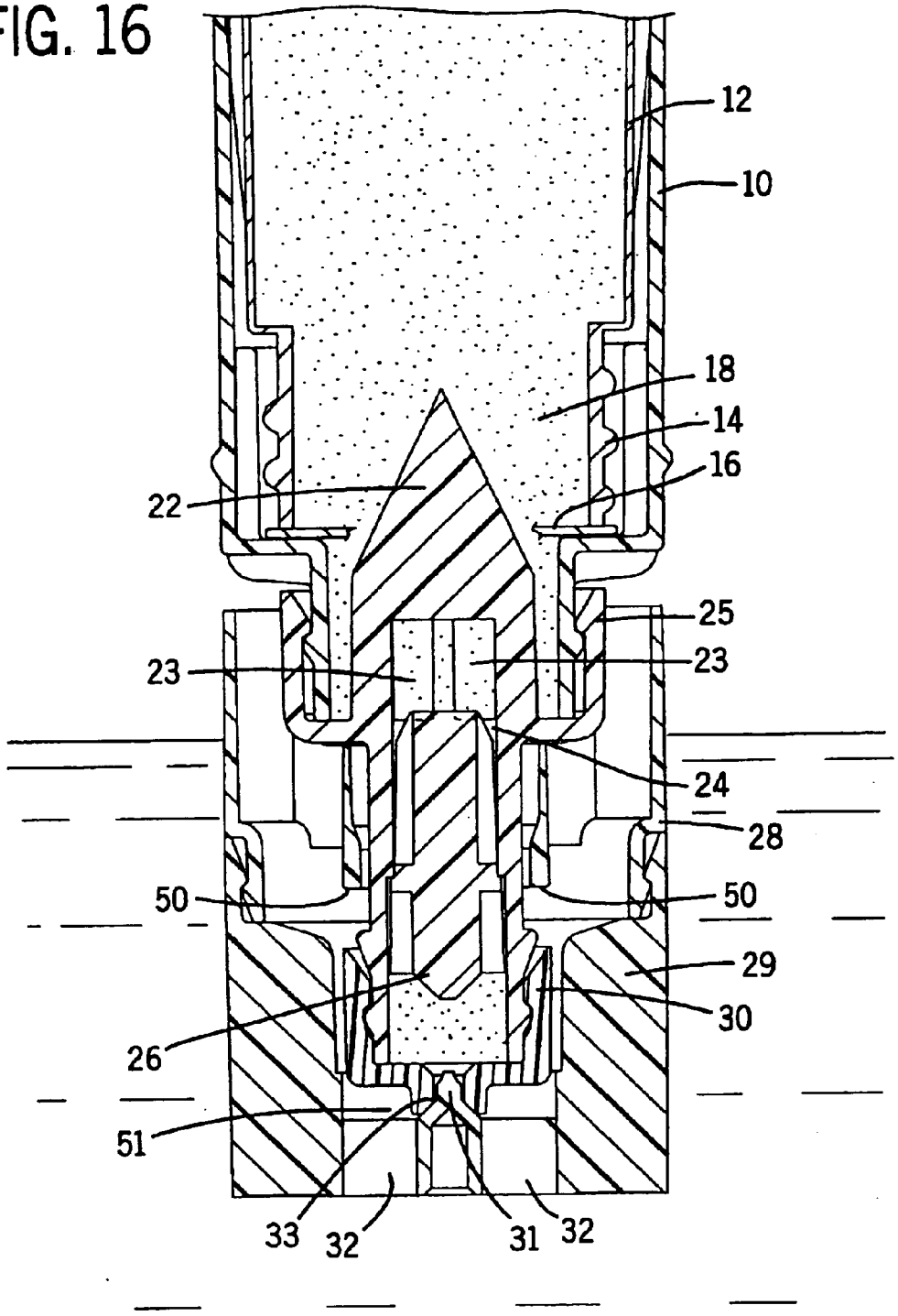
FIG. 16 is a view somewhat similar to FIG. 15, but with a lower stand removed, a bottle cap removed, and the bottle pushed down to pierce a bottle seal. This configuration assumes that the device is in a toilet tank that is filled.

The consumer then pushes down on the bottle, causing the piercing post 22 to pierce the seal 16, permitting the cleaning product to drain downward into side openings 23 and then into bore 24. Because the specific gravity of the cleaner liquid is greater than that of the shuttle 26, the shuttle will float upward in the bore 24, until it essentially closes off the side openings 23. However, at this point the cleaner cannot exit the dispenser as the head 31 is sealing off the outlet hole 33. In this regard, the float assembly 28, 29 is driven up by water to make a secure seal between elements 31 and 33. See generally FIG. 16.

When a flush cycle is initiated, the float assembly drops with the water until edge 50 of float part 28 rests against the top of cap 30. At this point, the head 31 no longer seals outlet hole 33. Cleaner can then drain out of the bore 24 into the reservoir 51. It can then pass by an outlet to passageway 32 and into the tank water.

Figure 17:
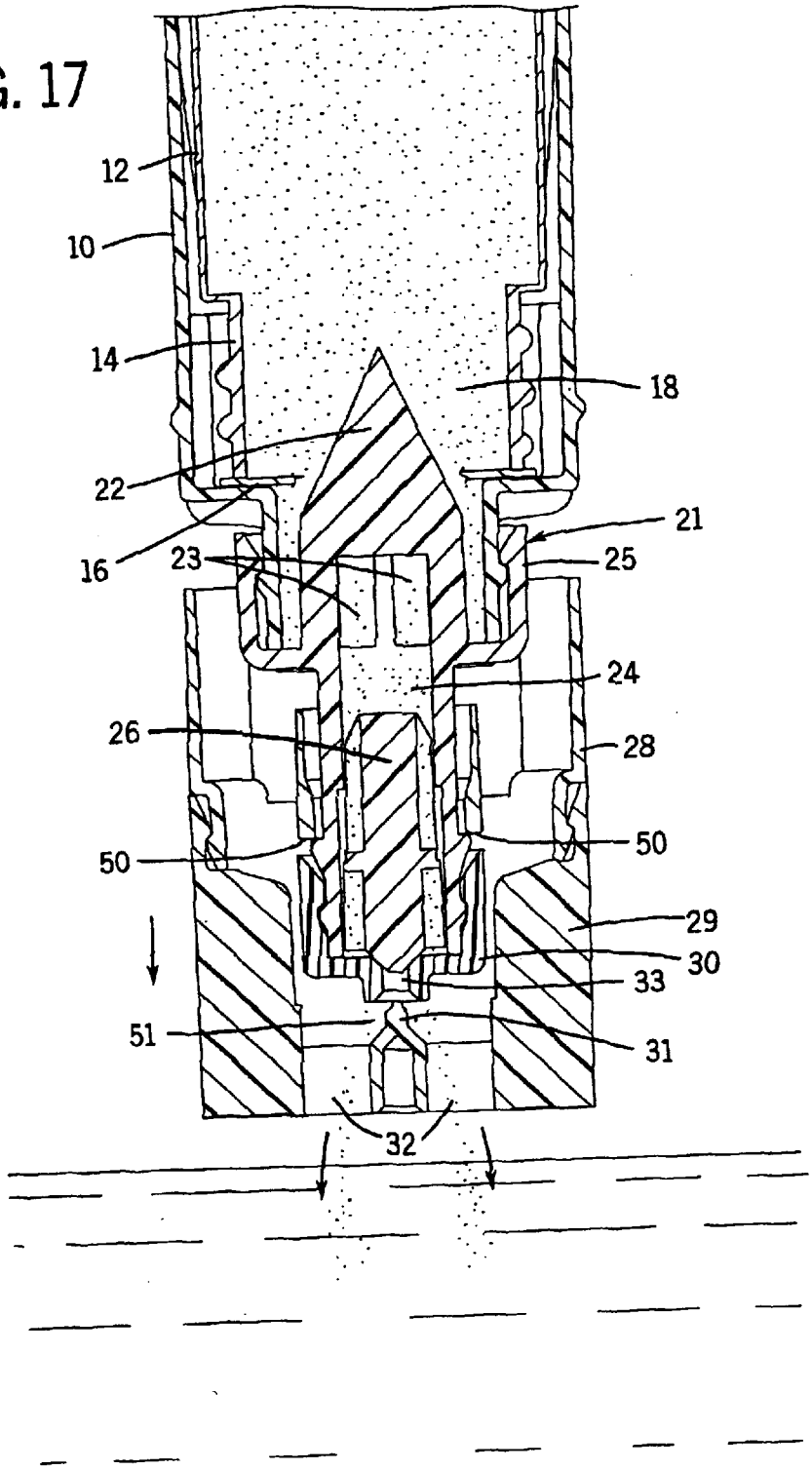
FIG. 17 is a view similar to FIG. 16, but showing a configuration when the toilet tank water is not at a fill level.

However, as this is happening the shuttle 26 drops to the bottom of the bore 24 so that a pointed portion of the shuttle seals off the outlet hole 33 from its top end. Air in the tank can now access the bottle via the gap between the float part 28 and the holster 10, to vent the bottle interior. Thus, regardless of how quickly the tank is refilled, only a single measured aliquot of cleaner will be dispensed during the down stroke of each flush. See FIG. 17.

When the tank refills the head 31 seals the outlet 33 from the bottom and slightly pokes the shuttle up. This permits a bleed of product that is above the shuttle to continue past and under the shuttle 26. The shuttle then floats up to its original position for the next cycle.

Figure 18:
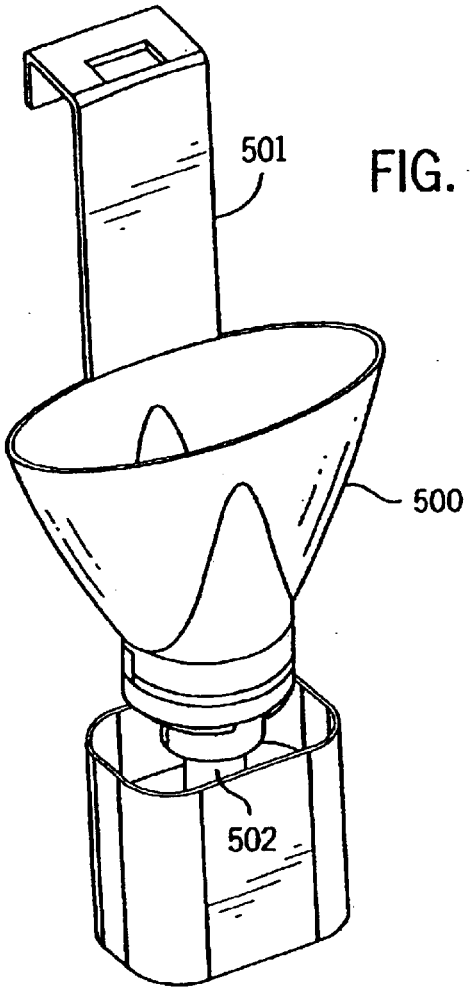
FIG. 18 is a left upper frontal perspective view of another embodiment of the dispenser, albeit with the refill bottle removed.
Figure 19:
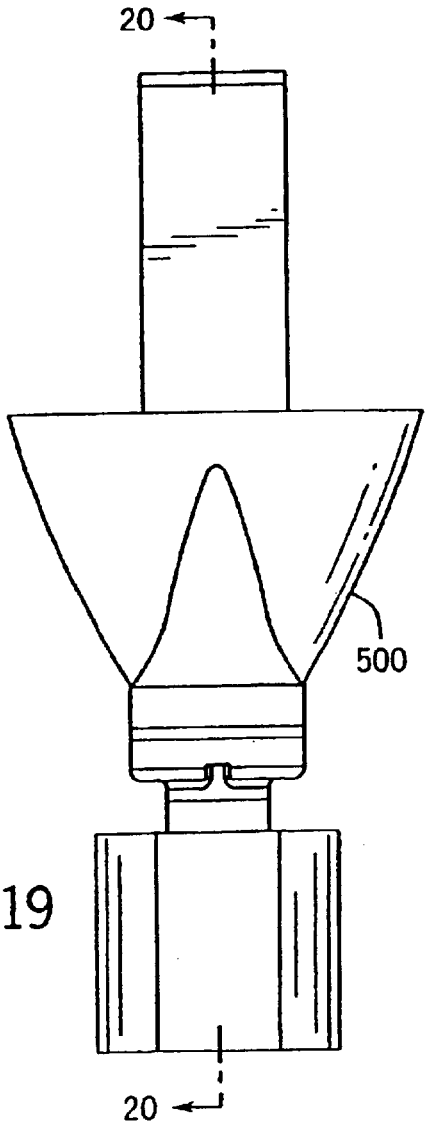
FIG. 19 is a front elevational view of the FIG. 18 dispenser.
Figure 20:
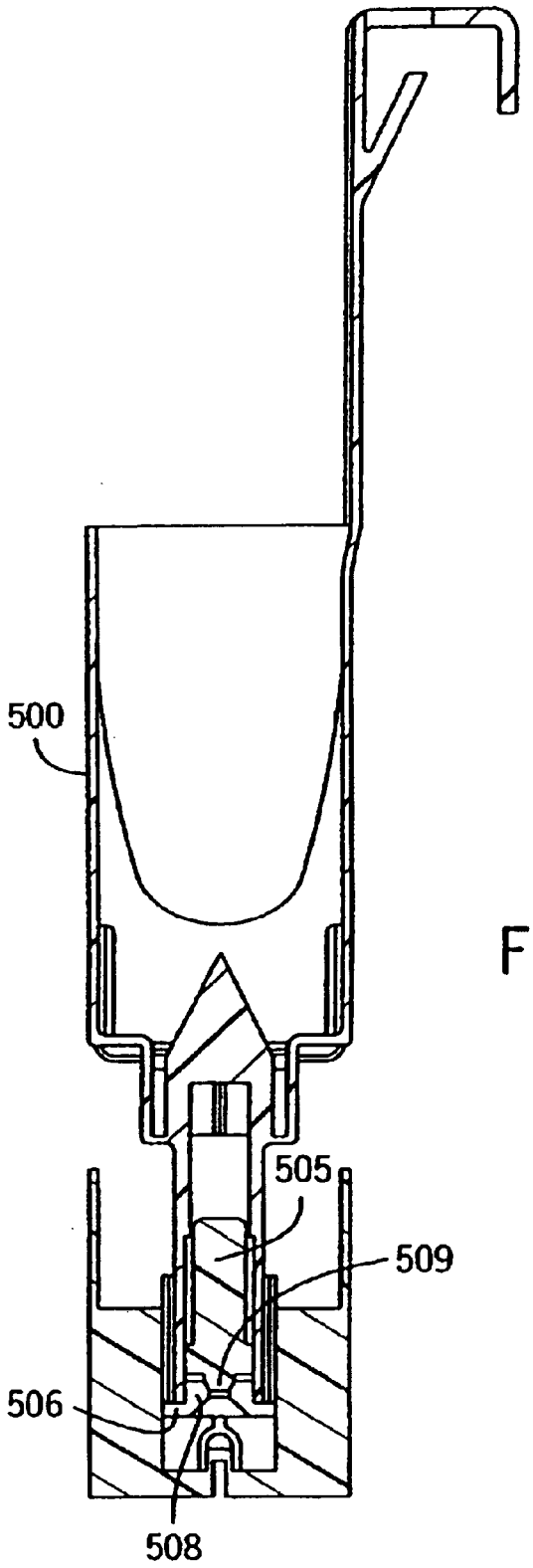
FIG. 20 is a sectional view taken along line 20 of FIG. 19.

Perhaps the most preferred form of the invention is depicted in FIGS. 18-20. There is a holster 500 having at its upper end an integral fixed hook 501, and at its lower end an outlet conduit 502. Much of the internal structure (for example, the floating shuttle 505) is largely the same as in other embodiments. However, this embodiment has several modifications of particular interest. For example, the design is provided with a grommet 506 which at its upper end provides the valve seat for the shuttle 505 and at its lower end provides the valve seat for the pin.

While the lower valve seat 508 is shown as conical, it could instead be hemispherical, with the valve pin on the floating valve being correspondingly hemispherical. The valve head 509 on the floating shuttle is shown as frustoconical, with a correspondingly shaped seat in the upper grommet surface. However, the head 509 could instead be largely cylindrical with slight tapering at the end.

If desired, the upper grommet surface can be made of a softer material than the lower grommet surface. This allows the seal with head 509 to be optimal, while leaving the exposed surface at the bottom of the grommet able to resist degradation from the toilet tank environment.

The embodiments discussed above are representative of embodiments of the present invention and are provided for illustrative purposes only. They are not intended to limit the scope of the present invention. Although components, materials, configurations, and means of connecting various parts have been shown and described, they are not limiting. Modifications and variations are contemplated within the scope of the present invention, which is intended to be limited only by the scope of the accompanying claims.

INDUSTRIAL APPLICABILITY

The invention provides dispensers for dispensing desired chemicals into bodies of water having water levels that rise and fall.

We claim:

1. A dispenser for use in a tank that has a liquid level that rises and falls, the dispenser comprising:

a container containing a dispensable product;

an adaptor for attachment to the container;

a dosing chamber in the adaptor having therein a floating shuttle that can essentially seal a lower opening in the dosing chamber in one mode, and alternatively can float upwardly from that sealing mode; and a floatable valve head positioned outside the dosing chamber for alternately opening and closing the lower opening in the dosing chamber;

wherein the shuttle has a lower specific gravity than that of the dispensable product such that after the floatable valve head closes the lower opening in the dosing chamber the lower specific gravity of the shuttle relative to that of the dispensable product will permit the shuttle to float upward; and wherein the dispenser is configured such that the dispenser can be operated without the shuttle and floatable valve head coming into contact with each other.

2. The dispenser of claim 1, further comprising a grommet that is not integral with the dosing chamber that is positioned adjacent the lower opening of the dosing chamber to form a valve seat for the floating shuttle.

3. The dispenser of claim 2, wherein the grommet also provides a valve seat for the floatable valve head.

4. The dispenser of claim 3, wherein the valve seat for the floatable valve head is essentially hemispherical in contour.

5. The dispenser of claim 1, further comprising an air inlet into the container.

6. The dispenser of claim 5, wherein an air pocket surrounds the air inlet.

7. The dispenser of claim 5, wherein the floatable valve head is surrounded by a reservoir.

8. The dispenser of claim 5, wherein an opening in the container has remnants of a seal that was pierced as the container was associated with the dispenser, and the adaptor has a piercing element above the dosing chamber which pierced the seal.

9. The dispenser of claim 8, wherein the container is an essentially rigid plastic container.

10. The dispenser of claim 5, wherein the container includes a refilling port.

11. The dispenser of claim 1, wherein the product comprises a cleaning agent selected from the group consisting of flowable gels and liquids.

12. The dispenser of claim 1, wherein if the dispenser is installed in the tank, and the liquid level in the tank is at a specified filled level, the floatable valve head can be driven by the liquid to a position sealing the lower opening of the dosing chamber.

13. The dispenser of claim 12, wherein if the dispenser is installed in the tank, and the liquid in the tank is emptied, the valve head can drop down away from sealing the lower opening of the dosing chamber to allow a dose of product in the dosing chamber to be released from the dispenser.

14. A dispenser for use in a tank that has a liquid level that rises and falls, the dispenser comprising:

a container;

an adaptor for attachment to the container;

a dosing chamber in the adaptor having therein a floating shuttle that can essentially seal a lower opening in the dosing chamber in one mode, and alternatively can float upwardly from that sealing mode;

a floatable valve head positioned outside the dosing chamber for alternately opening and closing the lower opening in the dosing chamber; and a grommet that is not integral with the dosing chamber that is positioned adjacent the lower opening of the dosing chamber to form a first valve seat for the floating shuttle and a second valve seat for the floatable valve head;

wherein the grommet is made of an upper layer of a first material and a lower layer of a second material different from the first such that the first valve seat for the floating shuttle is of the first material and the second valve seat for the floatable valve head is of the second material.

15. A dispenser for use in a tank that has a liquid level that rises and falls, the dispenser comprising:

a container;

an adaptor for attachment to the container;

a dosing chamber in the adaptor having therein a floating shuttle that can essentially seal a lower opening in the dosing chamber in one mode, and alternatively can float upwardly from that sealing mode; and a floatable valve head positioned outside the dosing chamber for alternately opening and closing the lower opening in the dosing chamber;

wherein the container is a flexible pouch.

16. A dispenser for use in a toilet tank that has a liquid level that rises and falls, the dispenser comprising:

a container containing a cleaning liquid;

an adaptor for attachment to the container;

a dosing chamber in the adaptor having therein a floating shuttle that can essentially seal a lower opening in the dosing chamber in one mode, and alternatively can float upwardly from that sealing mode; and a floatable valve head positioned outside the dosing chamber for alternatively opening and closing the lower opening in the dosing chamber;

wherein the shuttle has a lower specific gravity than that of the cleaning liquid such that after the floatable valve head closes the lower opening in the dosing chamber the lower specific gravity of the shuttle relative to that of the cleaning liquid can cause the shuttle to float upward; and wherein the dispenser is configured such that the dispenser can be operated without the shuttle and floatable valve head coming into contact with each other.

17. A method of cleaning a toilet having a water storage tank and a bowl, comprising the steps of:

(a) inserting into the tank a dispenser comprising a container containing a dispensable product, an adaptor for attachment to the container, a dosing chamber in the adaptor having therein a floating shuttle that can essentially seal a lower opening in the dosing chamber in one mode, and alternatively can float upwardly from that sealing mode, and a floatable valve head positioned outside the dosing chamber for alternately opening and closing the lower opening in the dosing chamber, wherein the floating shuttle can float upwardly from that sealing mode while the lower opening in the dosing chamber is closed, and wherein the dispenser is configured and positioned such that the water level of the tank controls the movement of the floatable valve head, and the product level in the dosing chamber controls the movement of the floating shuttle in the dosing chamber because a lower specific gravity of the floating shuttle causes the floating shuttle to be driven upward by the product having a higher specific gravity than that of the floating shuttle, the dispenser being configured such that the dispenser can be operated without the shuttle and floatable valve head coming into contact with each other; and (b) flushing the toilet.

18. The method of claim 17, wherein the dispenser further comprises a grommet that is not integral with the dosing chamber that is positioned adjacent the lower opening of the dosing chamber to form a valve seat for the floating shuttle.

19. The method of claim 17, wherein the dispenser dispenses the product while the water level in the tank is below a specified level.

20. A dispenser for use in a tank that has a liquid level that rises and falls, the dispenser comprising:

a container having a dispensable product therein;

an adaptor for attachment to the container;

a dosing chamber in the adaptor having therein a floating shuttle that can essentially seal a lower opening in the dosing chamber in one mode, and alternatively can float upwardly from that sealing mode; and a floatable valve head positioned outside the dosing chamber for alternately causing the opening and closing of the lower opening in the dosing chamber;

wherein the dispensable product has a higher specific gravity than that of the floating shuttle, and after the floatable valve head closes the lower opening in the dosing chamber the lower specific gravity of the shuttle relative to that of the dispensable product will cause the shuttle to float upward; and wherein the dispenser is configured such that the dispenser can be operated without the shuttle and floatable valve head coming into contact with each other.

* * * * *